US010548444B2

(12) United States Patent
Sun et al.

(10) Patent No.: US 10,548,444 B2
(45) Date of Patent: Feb. 4, 2020

(54) ROBOT CLEANER

(71) Applicant: LG ELECTRONICS INC., Seoul (KR)

(72) Inventors: Changhwa Sun, Seoul (KR); Sangjo Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 191 days.

(21) Appl. No.: 15/854,454

(22) Filed: Dec. 26, 2017

(65) Prior Publication Data

US 2018/0184867 A1 Jul. 5, 2018

(30) Foreign Application Priority Data

Dec. 30, 2016 (KR) ..... 10-2016-0184433
Oct. 16, 2017 (KR) ..... 10-2017-0134162
Oct. 16, 2017 (KR) ..... 10-2017-0134163

(51) Int. Cl.
*A47L 9/22* (2006.01)
*A47L 9/28* (2006.01)
(Continued)

(52) U.S. Cl.
CPC ..... *A47L 9/22* (2013.01); *A47L 9/009* (2013.01); *A47L 9/0411* (2013.01);
(Continued)

(58) Field of Classification Search
CPC ..... A47L 9/22; A47L 9/009; A47L 9/2884; A47L 2201/00
See application file for complete search history.

(56) References Cited

U.S. PATENT DOCUMENTS 3,790,987 A 2/1974 MacFarland
6,134,745 A 10/2000 Wörwag
(Continued)

FOREIGN PATENT DOCUMENTS

KR 10-0738886 7/2007
KR 10-2009-0131098 12/2009
(Continued)

OTHER PUBLICATIONS

United States Notice of Allowance dated Oct. 23, 2019 issued in co-pending related U.S. Appl. No. 15/856,213.

*Primary Examiner* — Bryan R Muller
(74) *Attorney, Agent, or Firm* — Ked & Associates, LLP

(57) ABSTRACT

A robot cleaner includes: a base body forming a bottom part of a cleaner body; a first wheel module and a second wheel module installed to be spaced apart from each other, and configured to moveably support the base body; a suction motor module and a battery module provided between the first and second wheel modules; and a suction nozzle module provided at a front side of the suction motor module and the battery module, and configured to suck air of a region to be cleaned, wherein a plurality of module accommodation portions which are open towards a lower side of the robot cleaner are formed at the base body, and wherein the first wheel module, the second wheel module, the suction motor module, the battery module, and the suction nozzle module are inserted into the module accommodation portions, respectively, in parallel to each other.

19 Claims, 17 Drawing Sheets

(51) Int. Cl.

| | |
|---|---|
| ***A47L 9/00*** | (2006.01) |
| ***A47L 9/04*** | (2006.01) |
| ***A47L 11/40*** | (2006.01) |
| *A47L 9/30* | (2006.01) |

(52) U.S. Cl.

CPC ..... *A47L 9/2842* (2013.01); *A47L 9/2884* (2013.01); *A47L 11/4011* (2013.01); *A47L 9/0455* (2013.01); *A47L 9/0477* (2013.01); *A47L 9/2821* (2013.01); *A47L 9/2826* (2013.01); *A47L 9/2857* (2013.01); *A47L 9/30* (2013.01); *A47L 11/4041* (2013.01); *A47L 11/4044* (2013.01); *A47L 2201/04* (2013.01); *A47L 2201/06* (2013.01)

(56) References Cited

U.S. PATENT DOCUMENTS

| | | | | |
|---|---|---|---|---|
| 6,324,714 | B1 | 12/2001 | Walz et al. | |
| 7,441,298 | B2 * | 10/2008 | Svendsen | A47L 5/30 15/49.1 |
| 8,387,193 | B2 * | 3/2013 | Ziegler | A47L 5/14 15/50.1 |
| 8,567,007 | B2 | 10/2013 | Song et al. | |
| 8,584,305 | B2 * | 11/2013 | Won | A47L 5/30 15/319 |
| 8,720,001 | B2 | 5/2014 | Courtney et al. | |
| 8,898,858 | B2 | 12/2014 | Dyson et al. | |
| 9,687,129 | B2 | 6/2017 | Kim et al. | |
| 9,833,116 | B2 | 12/2017 | Huang et al. | |
| 10,292,552 | B2 | 5/2019 | Lim et al. | |
| 2007/0244610 | A1 * | 10/2007 | Ozick | A47L 5/30 701/23 |
| 2010/0037418 | A1 * | 2/2010 | Hussey | A47L 5/30 15/319 |
| 2017/0265701 | A1 | 9/2017 | Kim et al. | |
| 2017/0296021 | A1 * | 10/2017 | Li | A47L 9/122 |

FOREIGN PATENT DOCUMENTS

| | | |
|---|---|---|
| KR | 10-1074937 | 10/2011 |
| KR | 10-2014-0123091 | 10/2014 |
| KR | 10-2016-0023120 | 3/2016 |
| KR | 10-2016-0035943 | 4/2016 |
| KR | 10-1641262 | 7/2016 |
| WO | WO 2013/106762 | 7/2013 |

* cited by examiner

ROBOT CLEANER

CROSS-REFERENCE TO RELATED APPLICATIONS

This application claims priority under 35 U.S.C. § 119 to Korean Application Nos. 10-2016-0184433, filed on Dec. 30, 2016, 10-2017-0134162, filed on Oct. 16, 2017, and 10-2017-0134163, filed on Oct. 16, 2017, whose entire disclosures are hereby incorporated by reference.

BACKGROUND

1. Field

This specification relates to a robot cleaner having a suction nozzle module which can be sanitarily managed. More particularly, the present disclosure relates to a robot cleaner capable of facilitating assembly processes and enhancing a productivity.

2. Background

A cleaner is an apparatus for performing a vacuum cleaning function which collects dust by separating the dust and foreign materials from sucked air, or performing a mop cleaning function through a mopping operation. Especially, a robot cleaner cleans a region to be cleaned, through an autonomous driving.

The cleaner is configured to simultaneously suck dust and air, and to separate the dust from the sucked air. The dust separated from the air is collected at a dust collector, and the air is discharged out of the cleaner. During this process, dust is accumulated not only in the dust collector, but also in the cleaner.

Therefore, the cleaner should be managed in order to maintain a clean state and a cleaning function. The management of the cleaner means periodically discharging dust collected at the dust collector, removing dust accumulated in the cleaner rather than the dust collector, etc.

For management of the cleaner, components of the cleaner should be separated from a cleaner body. However, in this process, a user should touch the components of the cleaner by hand, and may touch dust accumulated in the cleaner by hand. This may cause a problem in a sanitary aspect.

For instance, U.S. Pat. No. 8,720,001 (issued on May 13, 2014) discloses a configuration that an agitator is formed to be separable from a cleaner body. According to the patent document, a user should overturn a cleaner to take an agitator out by hand, in order to disassemble the agitator. Accordingly, the patent has a problem in a sanitary aspect that a user should touch dust accumulated in the agitator.

A cleaner having both a vacuum cleaning function and a mopping function is being developed. For usage of such a cleaner, a user detachably couples a brush assembly or a mop assembly to a cleaner body according to a desired cleaning type. However, in this case, it is impossible to change a cleaning mode of the cleaner in accordance with the mounted assembly.

In order to manufacture such a robot cleaner at a factory, a plurality of assembly processes should be performed. As the number of assembly processes or a diversity is increased, the assembly processes become difficult and the cleaner has a lowered productivity. Accordingly, in order to facilitate the assembly processes and enhance the productivity of the robot cleaner, the number of the assembly processes should be reduced and the robot cleaner should be manufactured by the same method.

Further, the robot cleaner has a difficulty in obtaining a radiation structure and a flow path structure due to its limited size. Especially, a structure to enhance the assembly processes may interfere with the radiation structure and the flow path structure.

The above reference is incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

Figure 1:
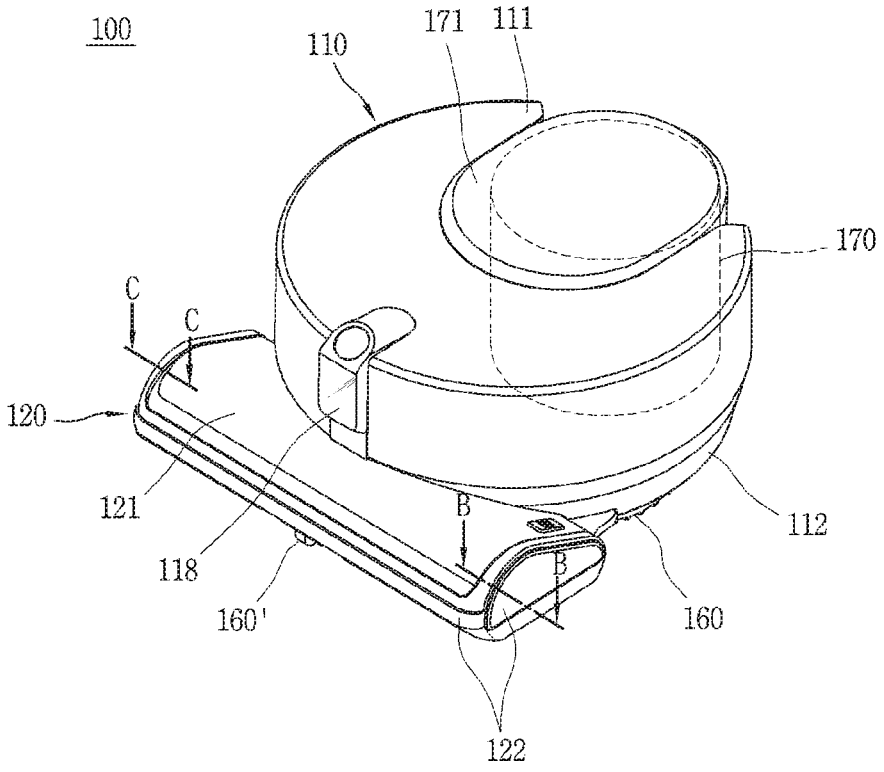
FIG. 1 is a perspective view showing an example of a robot cleaner according to the present disclosure.
Figure 2:
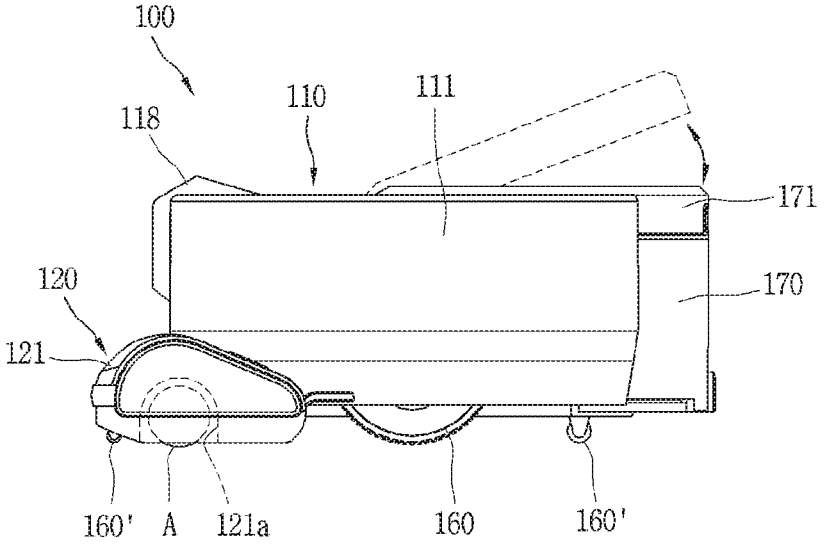
FIG. 2 is a side sectional view of the cleaner shown in FIG. 1.

Firstly, an appearance of a robot cleaner will be explained. FIG. 1 is a perspective view showing an example of a cleaner according to the present disclosure, and FIG. 2 is a side sectional view of the cleaner shown in FIG. 1.

The robot cleaner 100 may perform not only a function to suck dust on a floor, but also a function to mop a floor. For this, the robot cleaner 100 includes a cleaner body 110 and a suction nozzle module (or cleaner head module) 120.

The cleaner body 110 and the suction nozzle module 120 form appearance of the robot cleaner 100. The cleaner body 110 includes a controller (not shown) for controlling the robot cleaner 100, and various types of components are mounted in the cleaner body 110. Various kinds of components for cleaning a region to be cleaned are mounted to the suction nozzle module 120.

An appearance of the cleaner body 110 is formed by an outer cover 111 and a base body 112. The outer cover 111 and the base body 112 are coupled to each other to form the appearance of the cleaner body 110. The base body 112 forms a bottom part of the cleaner body 110, and is formed to accommodate therein the components of the robot cleaner 100. The outer cover 111 is coupled onto the base body 112.

Wheels 160, 160' for driving the robot cleaner 100 are provided at the cleaner body 110. The wheels 160, 160' may be provided on a bottom part of the cleaner body 110 and the suction nozzle module 120, respectively. By the wheels 160, 160', the robot cleaner 100 may be moved back and forth and right and left, or may be rotated.

For instance, if the robot cleaner 100 has an autonomous driving function, the wheels 160, 160' may be implemented as a wheel module 160 rotated by receiving a driving force. As another example, if the cleaner body 110 is moved by a user's manipulation, the wheels 160, 160' may have only a rolling function on a floor.

An auxiliary wheel 160' may be further provided at the cleaner body 110. The auxiliary wheel 160' supports the cleaner body 110 together with the wheel module 160, and may be formed to be rotatable by a manual operation. The auxiliary wheel 160' is configured to assist a driving of the robot cleaner 100 by the wheel module 160.

A dust container 170 is mounted to a rear side of the cleaner body 110. The cleaner body 110 may have a partially-recessed shape to accommodate the dust container 170 therein and to maintain a circular appearance. The dust container 170 may be provided with at least one of a filter for filtering dust and foreign materials from sucked air, and a cyclone.

The robot cleaner 100 may be provided with a dust container cover 171 for covering the dust container 170. In a state that the dust container cover 171 is arranged to cover an upper surface of the dust container 170, the dust container cover 171 may restrict the dust container. Thus, the dust container cover 171 may prevent the dust container 170 from being arbitrarily separated from the cleaner body 110.

FIG. 2 shows a configuration that the dust container cover 171 is formed to be rotatable by being hinge-coupled to the cleaner body 110. The dust container cover 171 may be fixed to the dust container 170 or the cleaner body 110, thereby maintaining the state to cover the upper surface of the dust container 170.

If the robot cleaner 100 has an autonomous driving function, a sensing unit 118 for sensing a surrounding situation may be provided at the cleaner body 110. A controller constituted by a main printed circuit board (PCB) 180 (refer to FIG. 16) may sense an obstacle or a terrain feature through the sensing unit 118, or may electronically generate a map of a driving area.

The suction nozzle module 120 is coupled to a front side of the cleaner body 110 in a protruded shape. An appearance of the suction nozzle module 120 is formed by a module mounting housing 121, and a cleaning module mounting portion 121*a* is formed in the module mounting housing 121. A cleaning module, or roller (A) formed as a brush module, a mop module, etc. is detachably mounted to the cleaning module mounting portion 121*a*.

A bumper switch 122 for sensing a physical collision may be installed outside the suction nozzle module 120. The bumper switch 122 may include a bumper member 122*a* which moves towards the inside of the suction nozzle module 120 by a physical collision with an obstacle, and a switch 122*b* pressurized when the bumper member 122*a* moves towards the inside of the suction nozzle module 120 (refer to FIG. 7). In the drawings, the suction nozzle module 120 is provided with the bumper switch 122. The bumper switch 122 is provided at a front side of the suction nozzle module 120, and may be provided at both sides in some cases.

As shown, if the suction nozzle module 120 is protruding from the cleaner body 110, the auxiliary wheel 160' may be provided at a bottom part of the suction nozzle module 120 for a stable driving of the robot cleaner 100.

The cleaning module (A) detachably-mounted to the cleaning module mounting portion 121*a* is configured to clean a region to be cleaned. Dust and foreign materials included in air sucked through the cleaning module (A) are separated from the air by a filter or a cyclone provided at the cleaner body or the dust container, and are collected at the dust container 170. And the suction nozzle module 120 is configured to clean a floor. Dust and foreign materials included in air sucked through the suction nozzle module 120 are filtered to be collected at a dust container 170. Then, the air separated from the dust and foreign materials is discharged to the outside of the cleaner body 110. An air suction passage (not shown) for guiding an air flow from the cleaning module mounting portion 121*a* to the dust container 170 may be formed in the cleaner body 110. Further, an air discharge passage (not shown) for guiding an air flow from the dust container 170 to the outside of the cleaner body 110 may be formed in the cleaner body 110.

The cleaning module (A) may selectively include a different type of cleaning member. The cleaning member indicates a brush, a rag or mop, etc. A type of the cleaning module (A) may be determined according to a type of the cleaning member. For instance, the cleaning module (A) having a brush may be categorized as a brush module 140 (refer to FIG. 5), and the cleaning module (A) having a mop may be categorized as a mop module 150 (refer to FIG. 6). One of the brush module and the mop module may be detachably coupled to the cleaning module mounting portion 121*a*. A user may replace the cleaning member or the cleaning module (A) according to a cleaning purpose.

The type of the cleaning member is not limited to a brush or a mop. Accordingly, the cleaning module having a different type of cleaning member may be referred to as a first type cleaning module and a second type cleaning module. The first cleaning module includes a first type cleaning member, and the first type cleaning member may mean a brush, for instance. Likewise, the second type cleaning module includes a second type cleaning member, and the second type cleaning member may mean a mop, etc. rather than a brush.

Figure 3:
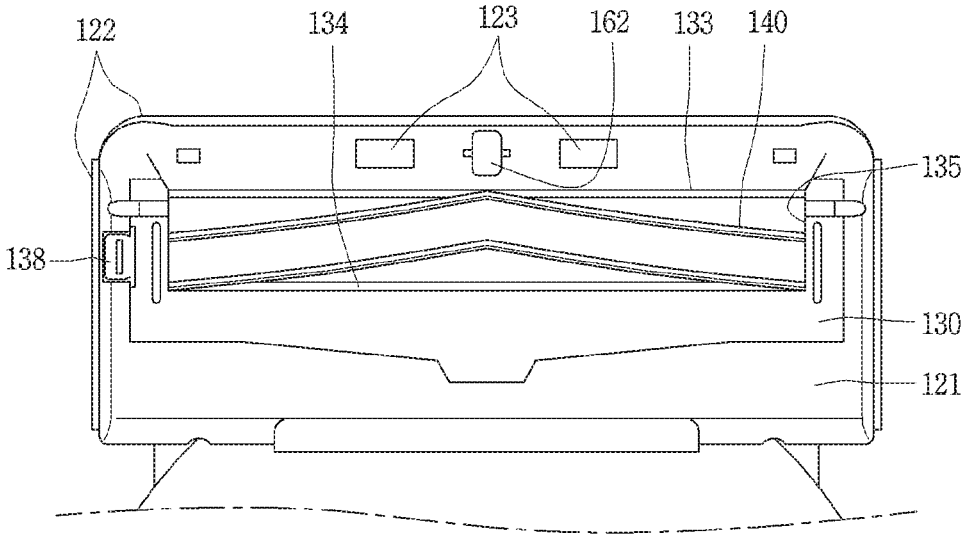
FIG. 3 is a conceptual view showing a bottom part of a suction nozzle module shown in FIG. 1.

Next, the suction nozzle module 120 will be explained. FIG. 3 is a conceptual view showing a bottom part of the suction nozzle module 120 shown in FIG. 1.

A cliff sensor 123 for sensing a lower terrain may be provided at a bottom part of the cleaner body 110. In the drawings, the cliff sensor 123 is provided at a bottom part of the suction nozzle module 120. The cliff sensor 123 may be provided at a bottom part of the cleaner body 110.

The cliff sensor 123 includes a light emitting portion and a light receiving portion, and time when light irradiated to a floor from the light emitting portion is received by the light receiving portion is measured. Based on the measured time, a distance between the cliff sensor 123 and the floor is measured. Accordingly, when there is a stairstep portion having its height lowered drastically at a front side, the reception time is drastically increased. If there is a cliff at a front side, light is not received by the light receiving portion.

If it is sensed, through the cliff sensor 123, that a lower terrain becomes lower by more than a predetermined level, the controller controls a driving of the wheel modules 160 (refer to FIG. 1). For instance, the controller may apply a driving signal in an opposite direction to the wheel module 160 such that the robot cleaner 100 may move in an opposite direction. Alternatively, for rotation of the robot cleaner 100, the controller may apply a driving signal to only one of the wheel modules 160, or may apply different driving signals to the right and left wheel module 160.

The cleaning module (A) for cleaning a floor may be detachably coupled to the cleaning module mounting portion 121*a* of the cleaner body 110. In the drawings, the brush module 140 is shown as an example of the cleaning module. However, the brush module 140 of the present disclosure may be applied to a general cleaning module such as a mop module to be explained later.

A supporting member (or roller frame) 130 is formed to support the brush module 140. The supporting member 130 is provided with a hook coupling portion 138 at one side thereof. As the hook coupling portion 138 is manipulated, the supporting member 130 may be separated from the suction nozzle module 120.

The supporting member 130 includes a first connection portion 133 and a second connection portion 134 spaced apart from each other. The first connection portion 133 is provided at a front side of the brush module 140, and the second connection portion 134 is provided at a rear side of the brush module 140. The brush module 140 is exposed to a space 135 between the first and second connection portions 133, 134, thereby cleaning a floor.

Figure 4:
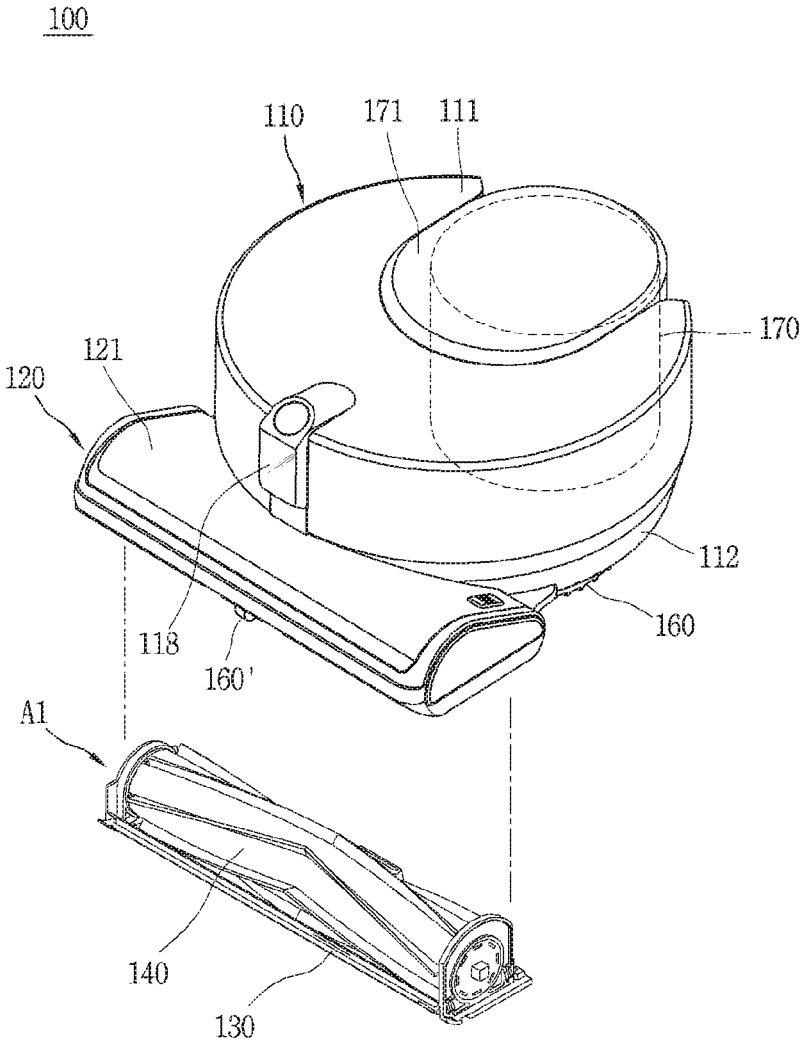
FIG. 4 is a conceptual view showing a cleaner body of FIG. 1, and a supporting member and a brush module separated from the cleaner body.

Next, the supporting member 130 and the brush module 140 will be explained. FIG. 4 is a conceptual view showing the cleaner body 110 of FIG. 1, and the supporting member 130 and the brush module 140 separated from the cleaner body 110.

The supporting member 130 and the brush module 140 are detachably mounted to the cleaning module mounting portion 121*a* (refer to FIG. 1) formed at a bottom part of the suction nozzle module 120. More specifically, the brush module 140 is coupled to the supporting member 130, and the supporting member 130 is formed to be mountable to the cleaning module mounting portion.

The supporting member 130 is inserted and mounted to the cleaning module mounting portion through the bottom part of the suction nozzle module 120. And the supporting member 130 is separated and withdrawn from the cleaning module mounting portion through the bottom part of the suction nozzle module 120.

Since the brush module 140 is coupled to the supporting member 130, the supporting member and the brush module form a single module (A1). If the supporting member 130 is inserted and mounted to the cleaning module mounting portion, the brush module 140 is also inserted and mounted to the cleaning module mounting portion together with the supporting member 130. Likewise, if the supporting member 130 is separated and withdrawn from the cleaning module mounting portion, the brush module 140 is also separated and withdrawn from the cleaning module mounting portion 121*a* together with the supporting member 130.

As shown in FIG. 4, the supporting member 130 and the brush module 140 are inserted and mounted to the cleaning module mounting portion in upper and lower directions. Accordingly, if the supporting member 130 and the brush module 140 are separated from the cleaning module mounting portion, they may be withdrawn from the cleaning module mounting portion 121*a* by their weight without an external force.

In the present disclosure, the brush module 140 is detachably coupled to the cleaner body 110 in a state that the supporting member 130 rotatably supports the brush module 140. However, the present disclosure is not limited to this. The brush module 140 may be directly detachably coupled to the cleaner body 110 without the supporting member 130. In this case, a structure corresponding to the supporting member 130 may be provided at the cleaning module mounting portion 121*a* of the cleaner body 110.

Figure 5:
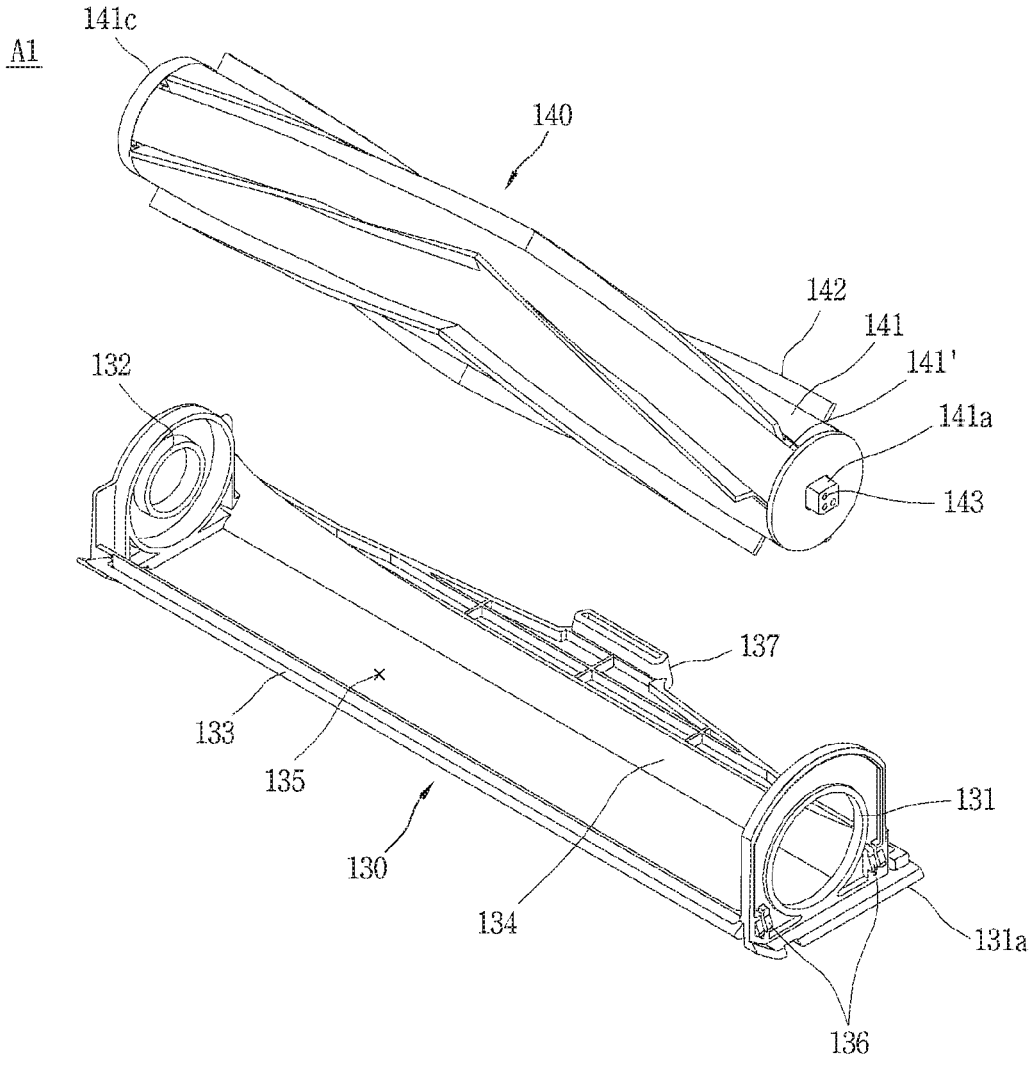
FIG. 5 is a disassembled perspective view of the supporting member and the brush module shown in FIG. 4.

FIG. 5 is a disassembled perspective view of the supporting member 130 and the brush module 140 shown in FIG. 4. The supporting member 130 is formed to rotatably support the brush module 140. The supporting member 130 includes a first supporting portion 131, a second supporting portion 132, the first connection portion 133, and the second connection portion 134.

The first and second supporting portions 131,132 are provided at both ends of the supporting member 130 so as to face each other. A separation distance between the first and second supporting portions 131, 132 may be equal to a length of a rotation rod 141.

The first and second supporting portions 131,132 enclose both ends of the rotation rod 141 so as to support the brush module 140 in a relatively rotatable manner. More specifically, the first supporting portion 131 encloses one end of the rotation rod 141, and the second supporting portion 132 encloses another end of the rotation rod 141.

The first and second connection portions 133,134 are configured to connect the first and second supporting portions 131,132 with each other. The first and second connection portions 133,134 may be spaced apart from each other at a front side and a rear side of the brush module 140. A brush 142 of the brush module 140 is exposed to the space 135 between the first and second connection portions 133, 134, thereby cleaning a floor.

The supporting member 130 is detachably coupled to the cleaning module mounting portion 121*a* of the cleaner body 110. For the coupling, at least one hook 136 formed to be locked to the cleaning module mounting portion may be provided at the supporting member 130. For instance, FIG. 5 shows that the hook 136 is formed at one end of the supporting member 130.

The hook 136 protrudes from an outer side surface of the first supporting portion 131. Once the supporting member 130 is inserted into the cleaning module mounting portion, the hook 136 is locked by a protrusion (not shown) formed on an inner side surface of the cleaning module mounting portion. With such a configuration, the hook 136 prevents any separation of the supporting member 130.

A protruding portion 137 protruding in an insertion direction of the supporting member 130 is formed at a rear side of the second connection portion 134. The protruding portion 137 protrudes towards the inside of the cleaning module mounting portion. Once the robot cleaner 100 (refer to FIG. 1) moves forward, the first and second connection portions 133,134 continuously receive an external force in a rear side of the robot cleaner. Here, the first connection portion 133 may be supported by the brush module 140, since the brush module 140 is coupled to a rear side of the first connection portion 133.

However, the second connection portion 134 may be damaged by a continuous external force, because the brush module 140 is not provided at a rear side of the second connection portion 134. To prevent this, the protruding portion 137 is formed to support the second connection portion 134.

A groove (not shown) corresponding to the protruding portion 137 is formed on an inner side surface of the cleaning module mounting portion, and the protruding portion 137 is inserted into the groove. The protruding portion 137 protrudes in an insertion direction of the supporting member 130, and a moving direction of the robot cleaner crosses the insertion direction. Accordingly, the protruding portion 137 may fix a position of the second connection portion 134 by preventing a movement of the second connection portion 134 in right and left directions and in upper and lower directions. This may prevent damage of the second connection portion 134.

The brush module 140 includes the rotation rod 141 and the brush 142. The rotation brush 141 is formed to extend in one direction. A rotation shaft of the rotation rod 141 may be provided to be perpendicular to a forward driving direction of the cleaner body 110. The rotation rod 141 is configured to be connected to a rotation driving portion 124 (refer to FIG. 7) when mounted to the cleaner body 110, and to be rotatable in at least one direction.

The rotation rod 141 is rotatably supported by the supporting member 130. The rotation rod 141 is formed to be rotatable in a restricted state to the supporting member 130. Accordingly, a rotation position of the rotation rod 141 may be fixed by the supporting member 130.

A rotation coupling member 141*a* is provided at one end of the rotation rod 141. The rotation coupling member 141*a* is exposed to the outside through one end of the rotation rod 141 in an axial direction. When the brush module is mounted to the cleaning module mounting portion of the cleaner body, the rotation coupling member 141*a* is coupled to the rotation driving portion 124 (refer to FIG. 7). With such a configuration, when the rotation driving portion 124 is driven, the rotation coupling member 141*a* transmits a driving force to the rotation rod 141 from the rotation driving portion 124.

The rotation coupling member 141*a* is exposed to the outside through one end of the rotation rod 141, and is formed to be pressed toward the inside of the rotation rod 141. The rotation coupling member 141*a* receives an elastic force by an elastic member 141*b* (refer to FIG. 7) to be explained later. Accordingly, even if the rotation coupling member 141*a* is pressed toward the inside of the rotation rod 141, the rotation coupling member 141*a* is restored to an initial position if an external force is removed.

If the separation distance between the first and second supporting portions 131, 132 is equal to the length of the rotation rod 141, it may be difficult to couple the brush module 140 to the supporting member 130 due to the rotation coupling member 141*a*. The reason is because the rotation coupling member 141*a* protrudes from one end of the rotation rod 141. However, since the rotation coupling member 141*a* can be pressurized, a difficulty in coupling the brush module 140 and the supporting member 130 with each other may be solved.

A rotation supporting portion 141*c* is installed at another end of the rotation rod 141. The rotation supporting portion 141*c* may have an outer circumferential surface formed as a curved surface so as to be rotatable in a restricted state to the second supporting portion 132 of the supporting member 130. The rotation supporting portion 141*c* may include a bearing 141*c*' (refer to FIG. 7).

The rotation supporting portion 141*c* is supported by the second supporting portion 132 of the supporting member 130 so as to be relatively rotatable. More specifically, the outer circumferential surface of the rotation supporting portion 141*c* is enclosed by the second supporting portion 132. As the rotation supporting portion 141*c* is supported by the second supporting portion 132, the rotation shaft of the rotation rod 141 may be provided to be aligned with a rotation shaft of the rotation driving portion 124.

For reference, if the rotation rod 141 is directly mounted to the cleaning module mounting portion 121*a* without the supporting member 130, a rotation supporting portion for rotatably supporting the rotation rod 141 may be additionally formed at the cleaning module mounting portion 121*a*.

As aforementioned, the rotation rod 141 may be rotatably mounted to the supporting member 130. In the drawings, the first supporting portion 131 is provided with a through hole for inserting the rotation rod 141, and the rotation coupling member 141*a* protrudes from one end of the rotation rod 141 exposed to the outside via the through hole.

The brush 142 is coupled to an outer circumferential surface of the rotation rod 141. A groove 141' is formed at the outer circumferential surface of the rotation rod 141, and the brush 142 may be inserted into the groove 141' in a lengthwise direction of the rotation rod 141.

The brush 142 may be provided to form an acute angle at a middle region of the rotation rod 141 in order to collect dust at the middle region. The reason is because a suction force of a suction motor provided from the cleaner body is the largest at the middle region of the rotation rod 141.

The brush 142 is configured to clean a floor by being rotated together with the rotation rod 141 when the rotation rod 141 is rotated. The brush 142 is an example of the cleaning member. Accordingly, the brush 142 may be replaced by another cleaning member such as a mop. A user may replace the cleaning member or the cleaning module by selection.

The brush module 140 may further include a contact terminal 143. FIG. 5 shows that the contact terminal 143 is formed on a surface of the rotation coupling member 141*a* exposed to the outside through one end of the rotation rod 141. However, the position of the contact terminal 143 is not limited to this. The contact terminal 143 may be formed on any position where it may contact a contact switch 125 (refer to FIG. 7) of the cleaner body as the brush module 140 and the cleaner body are coupled to each other.

If the contact terminal 143 is formed on the surface of the rotation coupling member 141*a*, the rotation driving portion 124 (refer to FIG. 7) is provided with the contact switch 125 at a contact position with the contact terminal 143. Accordingly, if the brush module 140 is mounted to the cleaner body 110 (refer to FIG. 1), the rotation coupling member 141*a* of the rotation rod 141 is inserted into the rotation driving portion 124. And the contact terminal 143 formed on the surface of the rotation coupling member 141*a* naturally contacts the contact switch. The reason is because the rotation coupling member 141*a* receives an elastic force from the elastic member 141*b* (refer to FIG. 7).

The controller of the robot cleaner may recognize a type of the cleaning module mounted to the cleaning module mounting portion, according to the number of the contact terminal 143 contacting the contact switch. For instance, FIG. 5 shows that the contact terminal 143 is provided in 3 in number, and FIG. 6 to be explained later shows that a contact terminal 153 is provided in 2 in number. Accordingly, if the number of the contact terminal contacting the contact switch is 3, the controller may recognize the cleaning module as the brush module 140. On the other hand, if the number of the contact terminal contacting the contact switch is 2, the controller may recognize the cleaning module as the mop module 150 (refer to FIG. 6).

The controller selects a cleaning algorithm of the robot cleaner based on a recognized type of the cleaning module. For instance, if the cleaning module is recognized as the brush module 140, the controller may rotate the brush module 140 and drive the suction motor and a fan, thereby generating a suction force. On the other hand, if the cleaning module is recognized as the mop module 150, the controller may rotate only the mop module without performing a dust suction operation.

Figure 6:
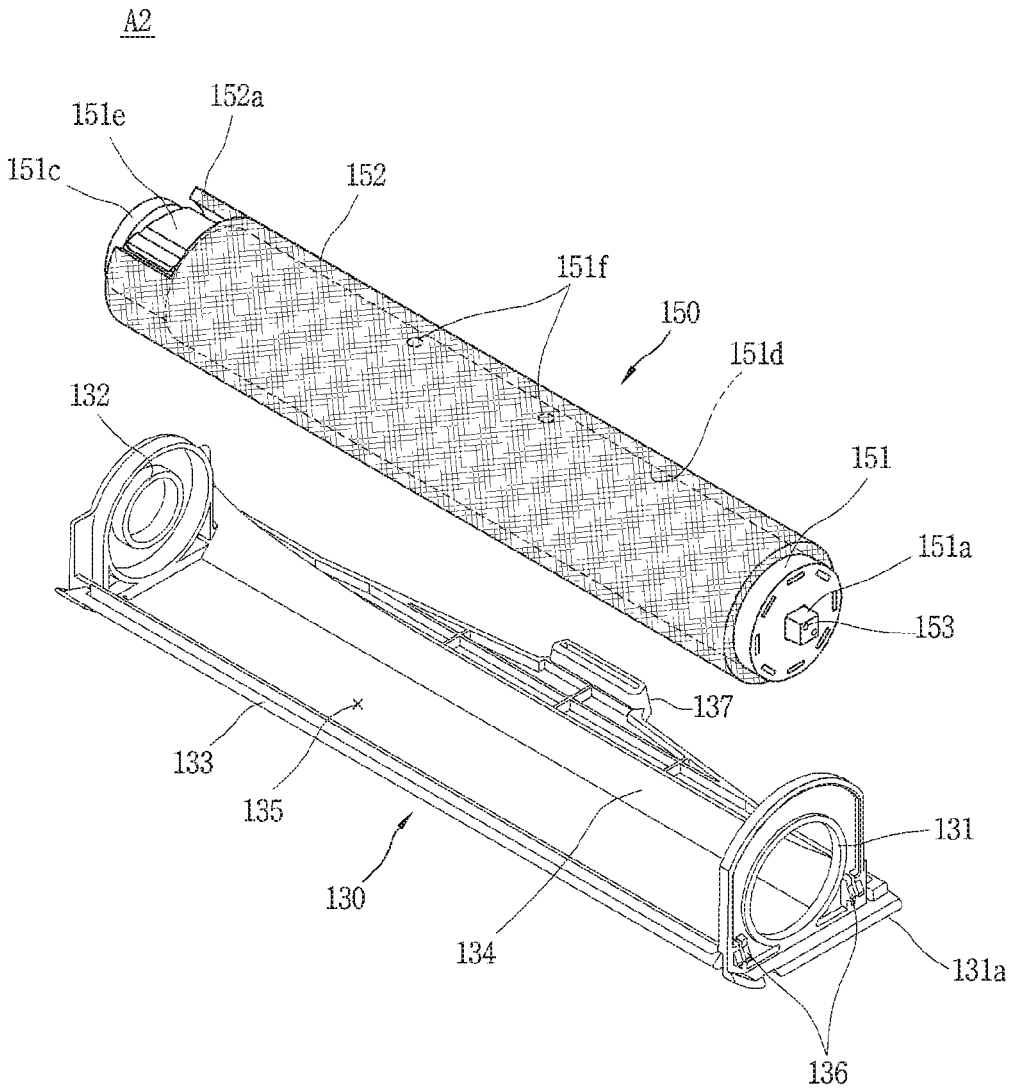
FIG. 6 is a disassembled perspective view of the supporting member and a mop module.

Hereinafter, the mop module will be explained as another example of the cleaning module. FIG. 6 is a disassembled perspective view of the supporting member 130 and the mop module 150.

Explanations about the supporting member 130 will be replaced by those shown in FIG. 5, and only the mop module 150 will be explained. Explanations about the mop module 150 will be omitted if they are the same as those about the brush module 140. When the supporting member 130 and the mop module 150 are coupled to each other, another module (A2) is formed.

A water accommodating portion 151*d* is formed in a rotation rod 151. A cover 151*e* (or a lid) through which water inside the water accommodating portion 151*d* is injected is formed on an outer circumferential surface of the rotation rod 151. If a user is to supplement water into the water accommodating portion 151*d*, the user may open the cover 151*e* to inject water into the water accommodating portion 151*d*.

Water discharge openings 151*f* communicated with the water accommodating portion 151*d* are formed on an outer circumference of the rotation rod 151. Water filled in the water accommodating portion 151*d* is discharged out through the water discharge openings 151*f*.

The water discharge opening 151*f* may be provided in plurality, and the plurality of water discharge openings 151*f* may be spaced apart from each other with a predetermined interval therebetween. In the drawings, the water discharge openings 151*f* are spaced apart from each other with a predetermined interval therebetween, in a lengthwise direction and a circumferential direction of the rotation rod 151. Alternatively, the water discharge openings 151*f* may be long extended in a lengthwise direction of the rotation rod 151.

All cleaning modules are compatible with each other. Accordingly, the mop module 150 is also mounted to the cleaning module mounting portion 121*a* (refer to FIG. 7) like the brush module 140 (refer to FIG. 5), and is rotatable as the rotation driving portion 124 (refer to FIG. 7) is driven. Accordingly, a centrifugal force is applied to the rotation rod 151 when the mop module 150 is rotated.

The water discharge opening 151*f* may have a preset size such that water filled in the water accommodating portion 151*d* may be discharged out through the water discharge openings 151*f* by a centrifugal force only when the mop module 150 is rotated. That is, water filled in the water accommodating portion 151*d* may not be discharged out through the water discharge openings 151*f* when the suction nozzle module 120 is not rotated.

The rotation rod 151 of the mop module 150 is provided with the contact terminal 153 on the same position as the rotation rod 141 of the brush module 140. However, the number of the contact terminals 153 provided at the rotation rod 151 of the mop module 150 is different from the number of the contact terminals 143 provided at the rotation rod 141 of the brush module. The reason is because the controller of the robot cleaner recognizes a type of the cleaning module based on the number of the contact terminal 153 contacting the contact switch 125 (refer to FIG. 7), which is explained with reference to the aforementioned FIG. 5.

If the brush module 140 and the mop module 150 are generalized as a first type cleaning module and a second type cleaning module, the cleaning module of the robot cleaner selectively includes the first type cleaning module and the second type cleaning module which are mountable to the supporting member. A rotation rod of the first type cleaning module and a rotation rod of the second type cleaning module are provided with a different number of contact terminals on the same position.

The robot cleaner is provided with a contact switch at a position where the contact switch contacts the contact terminal 153. The controller of the robot cleaner recognizes a type of the cleaning module coupled to the cleaning module mounting portion based on the number of the contact terminal contacting the contact switch. Then, a cleaning algorithm of the robot cleaner is selected based on the recognized type of the cleaning module.

Especially, the contact terminals 153 are preferably arranged to have the same distance from the center of a rotation coupling member 151*a*, such that contact positions between the contact terminals 153 and the contact switches are the same. The reason is because the contact switch contacts the contact terminal 153 regardless of an insertion angle of the rotation coupling member 151*a* into the rotation driving portion.

A mop 152 is formed to enclose an outer circumference of the rotation rod 151. The mop 152 is an example of the cleaning member. If the mop 152 is coupled to the rotation rod 151, the cleaning module is sorted as the mop module 150.

The mop 152 may be formed not to cover the cover 151*e*. In the drawings, the mop 152 is provided with a cut-out portion 152*a* corresponding to the cover 151*e*. Since the cover 151*e* is exposed to the outside without being covered by the mop 152, a user can inject water into the water accommodating portion 151*d* without separating the mop 152 from the rotation rod 151.

As shown, the mop 152 may be provided with a hollow portion corresponding to the rotation rod 151, and may be formed in a cylindrical shape having both ends open in a lengthwise direction. Alternatively, the mop 152 may be formed to be wound on an outer circumference of the rotation rod 151 and then to have its both ends attached with Velcro. The mop 152 may be formed to cover the water discharge openings 151*f* so as to be soaked by water discharged from the water discharge openings 151*f*.

The mop 152 may be formed of a soft textile material. Alternatively, the mop 152 may be formed such that a soft textile material may be formed on a base member formed of a hard material so as to maintain a shape. In this case, the base member is formed to enclose an outer circumference of the rotation rod 151, and is formed such that water discharged from the water discharge openings 151*f* passes therethrough. In FIG. 6, unexplained reference numeral 151*c* denotes a rotation supporting portion.

Figure 7:
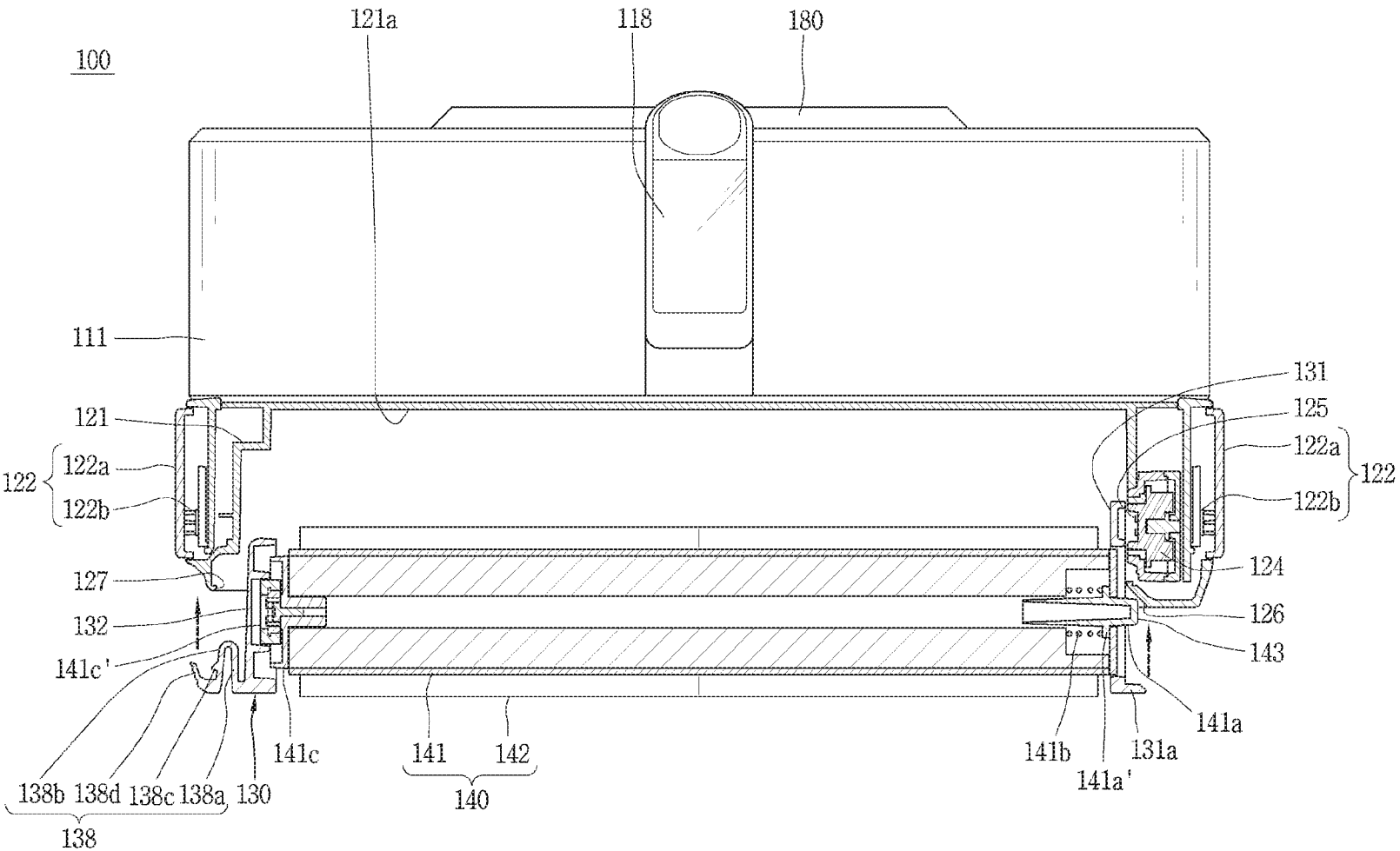
FIG. 7 is a conceptual view showing a process of mounting the brush module to the cleaner body.
Figure 8:
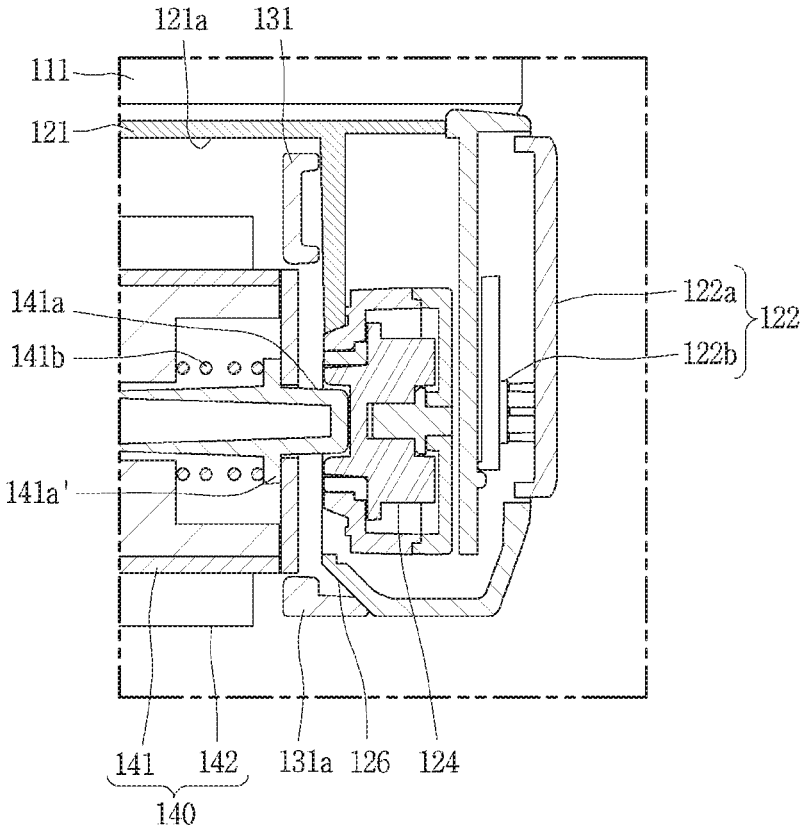
FIG. 8 is a sectional view taken along line 'B-B' in FIG. 1.
Figure 9:
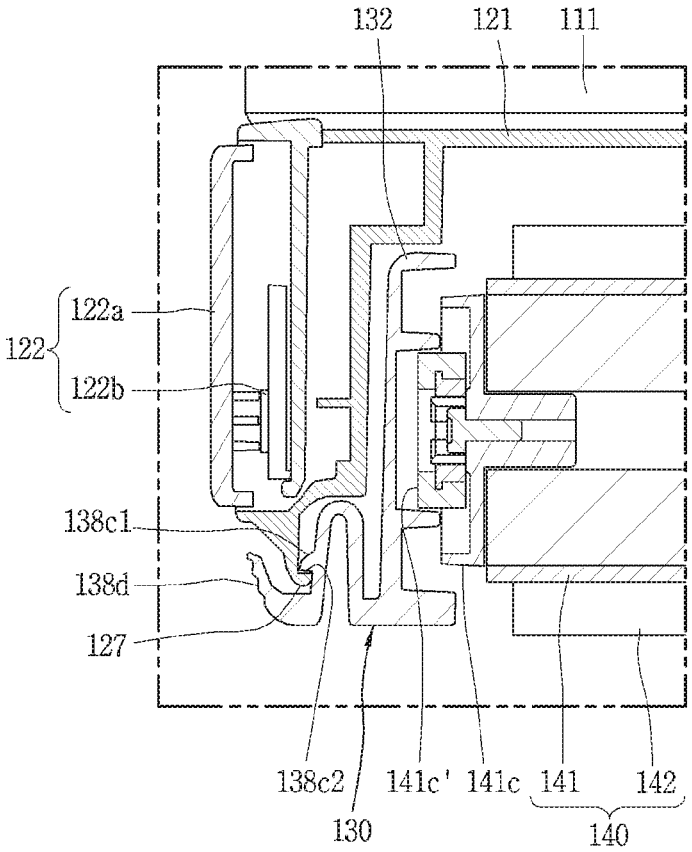
FIG. 9 is a sectional view taken along line 'C-C' in FIG. 1.

Next, a mounting structure of the supporting member 130 and the brush module 140 will be explained. FIG. 7 is a conceptual view showing a process of mounting the brush module 140 to the cleaner body 110, FIG. 8 is a sectional view taken along line 'B-B' in FIG. 1, and FIG. 9 is a sectional view taken along line 'C-C' in FIG. 1. FIGS. 8 and 9 show a mounted state of the supporting member and the brush module 140 to the cleaning module mounting portion 121*a*. Hereinafter, only components not explained in the aforementioned figures will be explained, and a process of mounting the brush module 140 to the cleaner body 110 will be explained.

As aforementioned, the rotation coupling member 141*a* is formed to be pressed towards the inside of the rotation rod 141. The rotation rod 141 further includes an elastic member 141*b*, and the elastic member 141*b* provides an elastic force such that the rotation coupling member 141*a* pressed towards the inside of the rotation rod 141 is restored to an initial position. The initial position means a state before the rotation coupling member 141*a* is pressed towards the inside of the rotation rod 141 by an external force, or a position in a state that an external force applied to the rotation coupling member 141*a* is removed.

The rotation coupling member 141*a* is provided with a separation prevention portion 141*a*' on an outer circumferential surface thereof. The separation prevention portion 141*a*' protrudes along the outer circumferential surface of the rotation coupling member 141*a*. Since a hole of the rotation rod 141 through which the rotation coupling member 141*a* is exposed is smaller than that of the separation prevention portion 141*a*', the separation prevention portion 141*a*' may prevent the rotation coupling member 141*a* from being separated from the rotation rod 141. Referring to FIG. 7, the elastic member 141*b* is formed to pressurize the separation prevention portion 141*a*'.

The rotation driving portion 124 is provided at one side of the cleaning module mounting portion 121*a*. The position of the rotation driving portion 124 corresponds to the position of the rotation coupling member 141*a* of the rotation rod 141. Accordingly, in a mounted state of the brush module 140 to the cleaning module mounting portion 121*a*, the rotation coupling member 141*a* is pressurized by an elastic force provided from the elastic member 141*b*, thereby being inserted into the rotation driving portion 124.

An inclined surface 126 is formed at an inlet of the cleaning module mounting portion 121*a*. The position of the inclined surface 126 is a contact position with the rotation coupling member 141*a* in a process of mounting the brush module 140. Accordingly, in the process of mounting the brush module 140, the rotation coupling member 141*a* may slide along the inclined surface 126 to thus be pressurized towards the inside of the rotation rod 141.

The inclined surface 126 is formed to be closer to the rotation coupling member 141*a* as it is towards the inside of the cleaning module mounting portion 121*a*. Accordingly, during a mounting process of the brush module 140, the rotation coupling member 141*a* may be gradually pressurized towards the inside of the rotation rod 141 by the inclined surface 126.

With regards to another end of the rotation rod 141, the rotation supporting portion 141*c* is provided with a bearing 141*c*'. The bearing 141*c*' is exposed to the outside through another end of the rotation rod 141. The second supporting portion 132 of the supporting member 130 encloses an outer circumferential surface of the bearing 141*c*', and the second supporting portion 132 encloses the rotation supporting portion 141*c* at an outer periphery of the bearing 141*c*'. Accordingly, the rotation rod 141 is rotated in a restricted state to the second supporting portion 132.

The supporting member 130 is provided with a hook coupling portion 138 so as to be prevented from being arbitrarily separated from the cleaning module mounting portion 121*a*. The hook coupling portion 138 is locked to a protrusion 127 of the cleaning module mounting portion 121*a*. Referring to FIG. 7, the protrusion 127 protrudes from an inlet of the cleaning module mounting portion 121*a* towards the supporting member 130.

The hook coupling portion 138 includes a first part 138*a*, a second part 138*b*, a locking protrusion 138*c* and a manipulation portion 138*d*. The first part 138*a* protrudes from one end of the supporting member 130 towards the inside of the cleaning module mounting portion 121*a*. Referring to FIG. 7, a direction of the inside of the cleaning module mounting portion 121*a* means an upward direction. The second part 138*b* is bent from the first part 138*a*, and protrudes towards the outside of the cleaning module mounting portion 121*a*. Referring to FIG. 7, a direction of the outside of the cleaning module mounting portion 121*a* means a downward direction.

As the first and second parts 138*a*, 138*b* have different protruding directions from each other, a bending stress occurs between the first and second parts 138*a*, 138*b* by an external force. The bending stress means a resistive force occurring from the inside of a material as a bending moment is applied to the material. Accordingly, the first and second parts 138*a*, 138*b* have a property to restore a state before the external force is applied.

The manipulation portion 138*d* protrudes from the end of the second part 138*b* so as to manipulate the hook coupling portion 138. Since the manipulation portion 138*d* is exposed to the outside through a bottom part of the cleaner body 110, it can be manipulated by a user's finger.

The locking protrusion 138*c* protrudes from a middle region of the second part 138*b* towards the protrusion 127, so as to be locked to the protrusion 127. Accordingly, if the supporting member 130 is inserted into the cleaning module mounting portion 121*a*, the locking protrusion 138*c* is locked to the protrusion 127 of the cleaning module mounting portion 121*a*. Arbitrary separation of the supporting member 130 may be prevented by the locking protrusion 138*c* and the protrusion 127.

The locking protrusion 138*c* includes an inclined surface 138*c*1 and a locking surface 138*c*2. The inclined surface 138*c*1 contacts the protrusion 127 during an insertion process of the supporting member 130, and is formed to be slidable along the surface of the protrusion 127. With such a configuration, the inclined surface 138*c*1 contacts the protrusion 127 and passes through the protrusion 127 during an insertion process of the supporting member 130.

The locking surface 138*c*2 is formed at an opposite side to the inclined surface 138*c*1. The locking surface 138*c*2 is formed to be locked to the protrusion 127 in a mounted state of the supporting member 130 to the cleaning module mounting portion 121*a*. Preferably, the protrusion 127 protrudes towards the inside of the cleaning module mounting portion 121*a* in order to prevent arbitrary release of a locked state, and the locking surface 138*c*2 is formed to plane-contact the protrusion 127.

In a mounted state of the supporting member 130 to the cleaning module mounting portion 121*a*, the manipulation portion 138*d* is spaced apart from the cleaner body 110 so as to be pressurized. Referring to FIG. 7, the cleaner body 110 means a rear surface of the protrusion 127. If the manipulation portion 138*d* is adhered to the rear surface of the protrusion 127, it is impossible to release a locked state of the locking protrusion 138*c* and the protrusion 127 by pressing the manipulation portion 138*d*.

In order to mount the supporting member 130 and the brush module 140 to the cleaning module mounting portion 121*a*, the supporting member 130 and the brush module 140 are coupled to each other. Then, the supporting member 130 and the brush module 140 are inserted into the cleaning module mounting portion 121*a* through a bottom part of the cleaner body 110.

During the mounting process of the supporting member 130 and the brush module 140, the rotation coupling member 141*a* of the rotation rod 141 contacts the inclined surface 126. And the hook coupling portion 138 of the supporting member 130 contacts the protrusion 127.

During the mounting process of the brush module 140, the rotation coupling member 141*a* contacting the inclined surface 126 is slid along the inclined surface 126. As the brush module 140 is inserted into the cleaning module mounting portion 121*a*, the rotation coupling member 141*a* is gradually pressurized towards the inside of the rotation rod 141 by the inclined surface 126. If the brush module 140 is inserted into the cleaning module mounting portion 121*a*, the rotation coupling member 141*a* passes through an inner plane of the cleaning module mounting portion 121*a* via the inclined surface 126. While passing through the inner plane of the cleaning module mounting portion 121*a*, the rotation coupling member 141*a* maintains a pressed state towards the inside of the rotation rod 141 by the inner plane.

The rotation driving portion 124 is formed to accommodate the rotation coupling member 141*a* therein. If the brush module 140 is continuously inserted into the cleaning module mounting portion 121*a*, the rotation coupling member 141*a* reaches a position where it faces the rotation driving portion 124. Here, the rotation coupling member 141*a* is restored to an initial position by an elastic force provided from the elastic member 141*b*, thereby being inserted into the rotation driving portion 124.

While the rotation coupling member 141*a* is inserted into the rotation driving portion 124, the hook coupling portion 138 is coupled to the protrusion 127. While the supporting member 130 is inserted into the cleaning module mounting portion 121*a*, the locking protrusion 138*c* of the hook coupling portion 138 contacts the protrusion 127 of the cleaning module mounting portion 121*a*, and is pressurized by the protrusion 127. The locking protrusion 138*c* and the second part 138*b* are pressurized towards the first part 138*a* by the protrusion 127. If the supporting member 130 is inserted into the cleaning module mounting portion 121*a* more deeply by an additional force, the inclined surface 126 of the locking protrusion 138*c* overcomes a resistive force to the protrusion, and the locking protrusion 138*c* is locked to the protrusion 127.

FIGS. 8 and 9 show a mounted state of the supporting member 130 and the brush module 140 to the cleaning module mounting portion 121*a*. The supporting member 130 is provided with a shield 131*a* at a lower end of the first supporting portion 131. A space between the supporting member 130 and the cleaning module mounting portion 121*a* may be exposed to the outside by the inclined surface 126 formed at the cleaning module mounting portion 121*a*. However, the shield 131*a* protrudes from one end of the supporting member 130 to block the space. This may prevent foreign materials such as dust from being accumulated in the space. As aforementioned, if the brush module 140 is completely mounted, the contact terminal 143 (refer to FIG. 5) of the brush module 140 contacts the contact switch 125 provided at the rotation driving portion 124.

Figure 10:
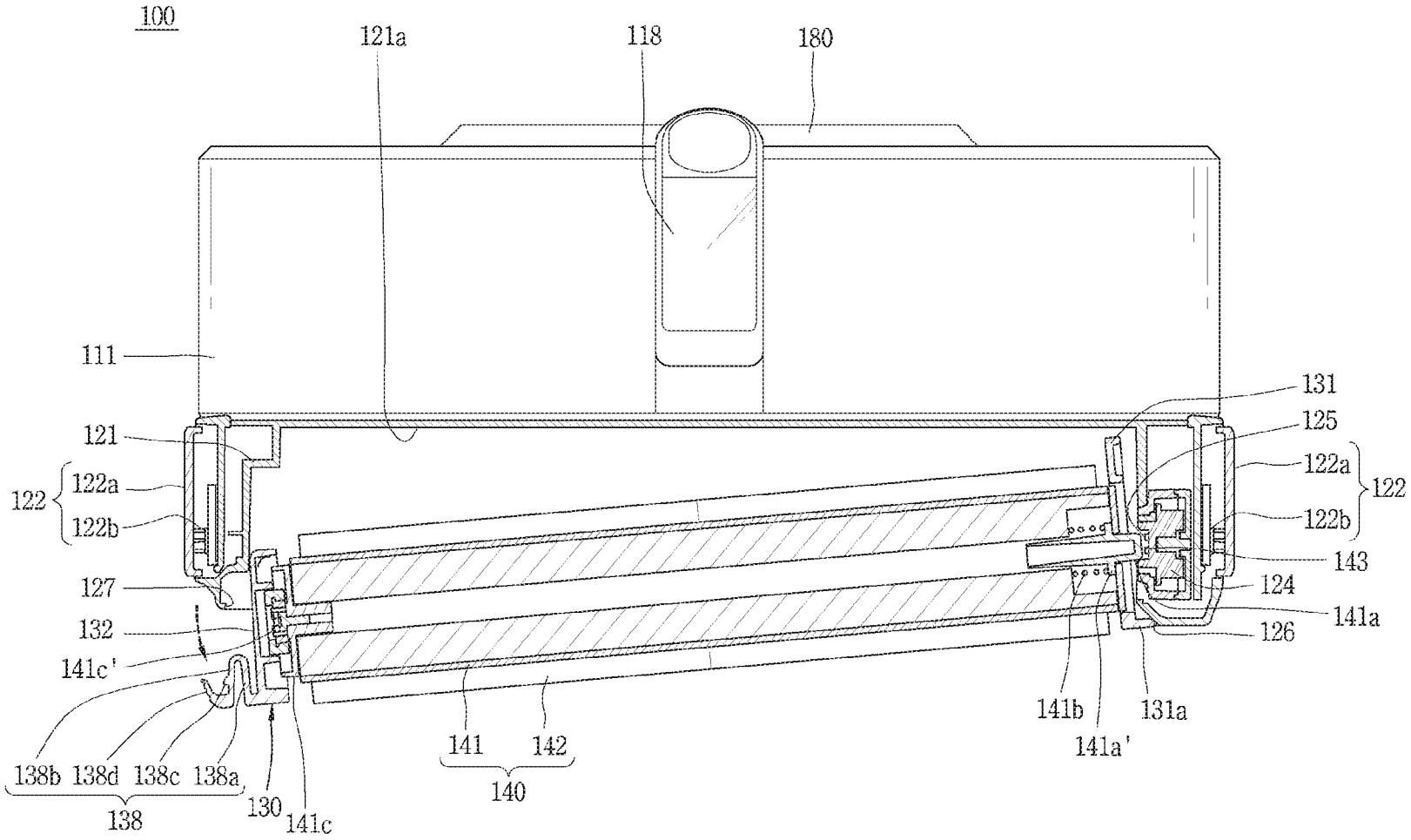
FIG. 10 is a conceptual view showing a process of separating the brush module from the cleaner body.

Next, a separation structure of the supporting member and the brush module will be explained. FIG. 10 is a conceptual view showing a process of separating the brush module 140 from the cleaner body 110. The process of separating the brush module 140 from the cleaner body 110 may be understood to be opposite to the mounting process.

If the manipulation portion 138*d* of the hook coupling portion 138 is pressurized in an axial direction of the rotation rod 141, the second part 138*b* and the locking protrusion 138*c* are pushed towards the first part 138*a*. Accordingly, the coupled state between the protrusion 127 and the locking protrusion 138*c* is released, and thus the hook coupling portion 138 becomes a free end.

If the coupled state between the protrusion 127 and the locking protrusion 138*c* is released, the supporting member 130 and the brush module 140 are tilted on the basis of the rotation coupling member 141*a* to thus be separated from the cleaning module mounting portion 121*a*. If the supporting member 130 and the brush module 140 are pulled in an axial direction of the rotation rod 141 in a state that the supporting member 130 and the brush module 140 are inclined from the original position, the supporting member 130 and the brush module 140 are withdrawn from the cleaning module mounting portion 121*a*.

In the present disclosure, the suction nozzle module 120 (refer to FIG. 2) is inserted and mounted to the cleaning module mounting portion 121*a* together with the supporting member 130, and is separated and withdrawn from the cleaning module mounting portion 121*a* together with the supporting member 130. This is advantageous in a sanitary aspect, because most of dust is accumulated on the cleaning module, and a user can mount or separate the cleaning module to or from the cleaning module mounting portion 121*a* by holding only the supporting member 130 without touching the cleaning module.

Further, since the supporting member 130 and the cleaning module are inserted and withdrawn at a bottom part of the cleaner body 110 in an upper and lower direction, convenience in mounting and/or separating the supporting member 130 and the cleaning module may be enhanced. For instance, if a user lifts the cleaner body 110 after pressurizing the manipulation portion 138*d* of the hook coupling portion 138, the supporting member 130 and the cleaning module may be separated from the cleaning module mounting portion 121*a* by their weight. Accordingly, in the present disclosure, inconvenience in overturning the cleaner body 110 may be solved.

Further, in the present disclosure, a type of the cleaning module is automatically recognized, and a cleaning algorithm is selected according to the recognized type of the cleaning module. This may enhance performance of the robot cleaner having an autonomous driving function and an automatic cleaning function.

Next, the cleaner body 110 will be explained. Especially, a physical and electrical coupling structure of the wheel module 160 and the suction nozzle module 120 to the cleaner body 110 will be explained.

Figure 11:
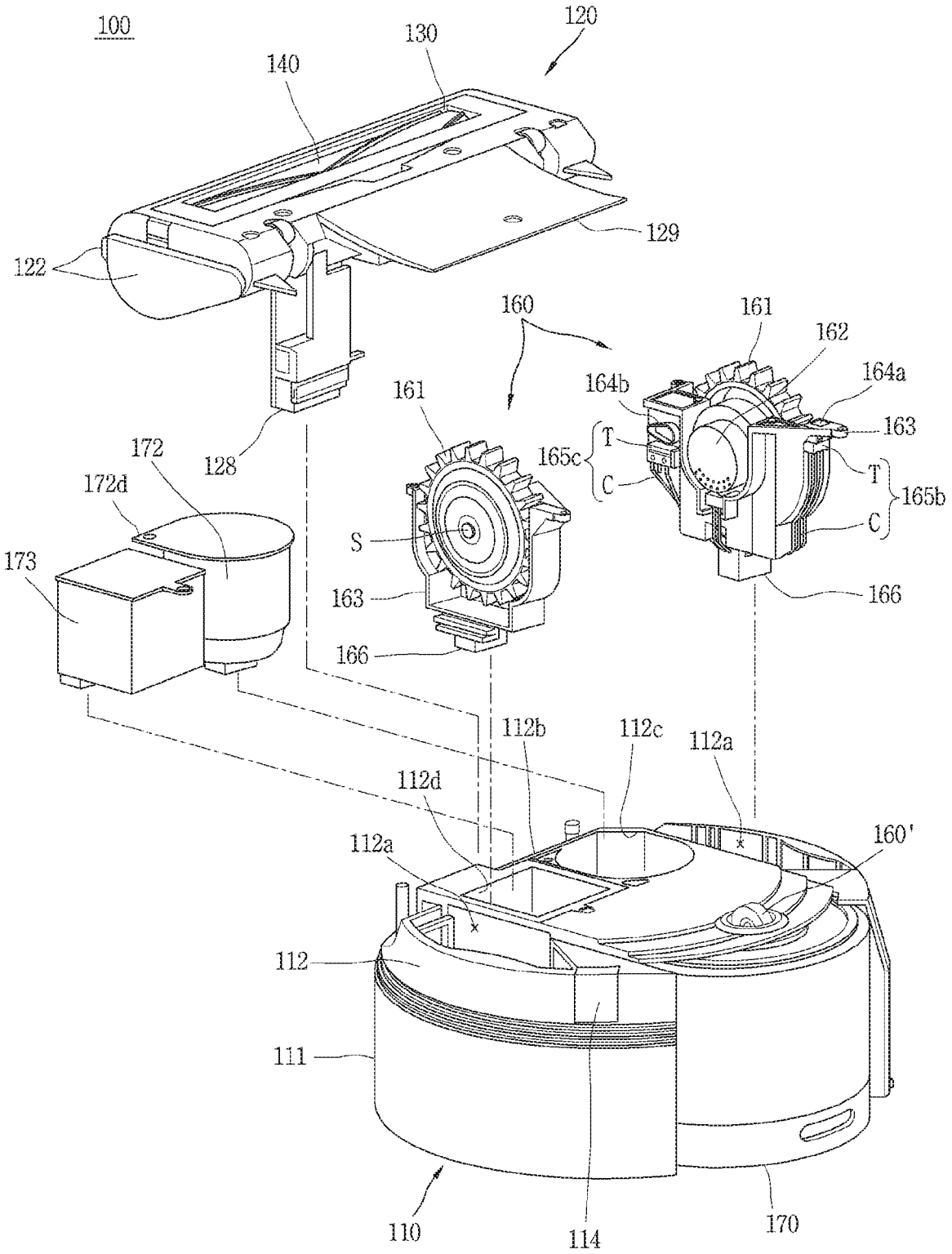
FIG. 11 is a disassembled perspective view of the cleaner body, the suction nozzle module and a wheel module.
Figure 12:
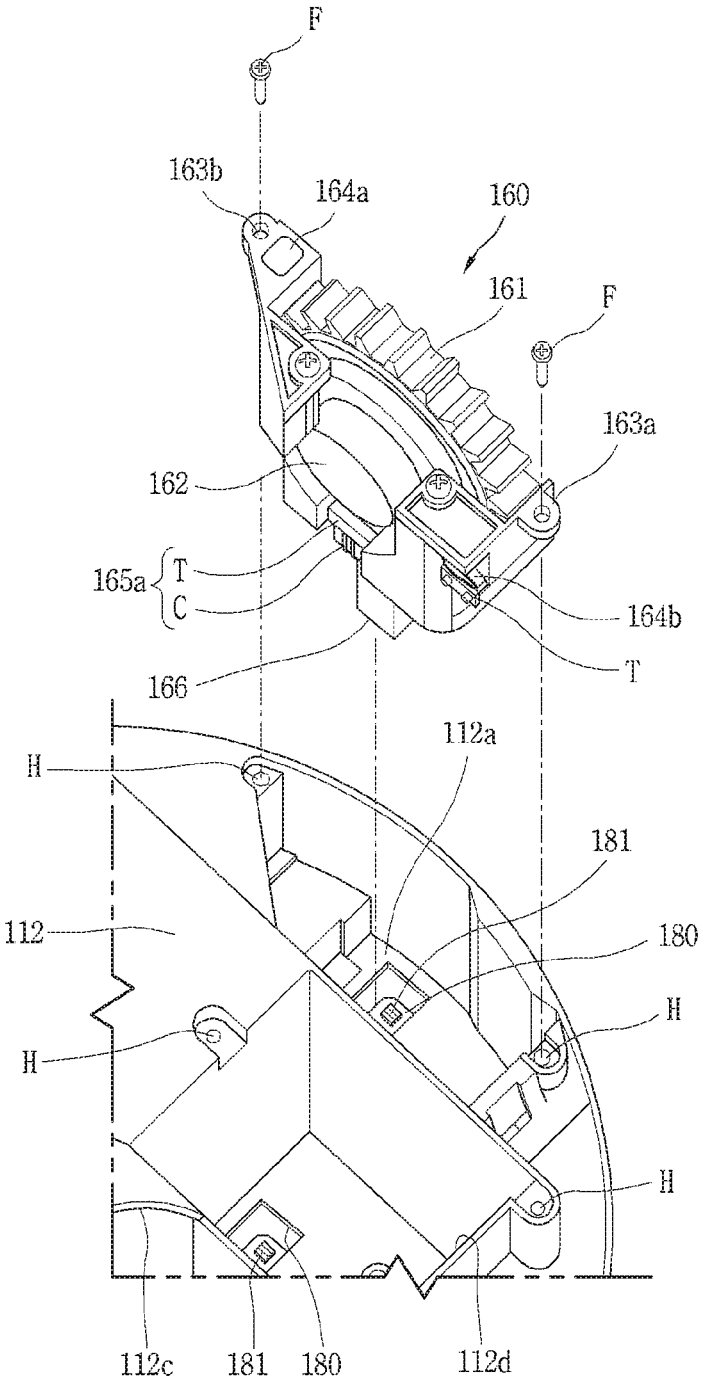
FIG. 12 is a conceptual view for explaining a physical and electrical coupling structure between the cleaner body and the wheel module.

FIG. 11 is a disassembled perspective view of the cleaner body 110, the wheel module 160 and the suction nozzle module 120, and FIG. 12 is a conceptual view for explaining a physical and electrical coupling structure between the cleaner body 110 and the wheel module 160.

As aforementioned, the appearance of the cleaner body 110 is formed by an outer cover 111 and a base body 112. The outer cover 111 forms an appearance of an upper part and side surfaces of the cleaner body 110, and the base body 112 forms an appearance of a lower part of the cleaner body 110. Accordingly, as shown in FIG. 11, when the cleaner body 110 is turned upside down, a bottom surface of the base body 112 is exposed.

A plurality of module accommodation portions (or accommodation recesses) 112*a*, 112*b*, 112*c*, 112*d* which are open towards a lower side of the robot cleaner 100 are formed at the base body 112. The number of the module accommodation portions 112*a*, 112*b*, 112*c*, 112*d* may be the same as the number of modules coupled to the cleaner body 110. And each of the module accommodation portions 112*a*, 112*b*, 112*c*, 112*d* has a shape corresponding to a module to be mounted thereto.

FIG. 11 shows a configuration that the wheel module 160, a suction motor module 172, a battery module 173, and the suction nozzle module 120 are mounted to the module accommodation portions 112*a*, 112*b*, 112*c*, 112*d*. Each of the wheel module 160, the suction motor module 172, the battery module 173, and the suction nozzle module 120 is formed as a module which can be coupled to and separated from the cleaner body 110. The module is a constituent unit of a machine, a system, etc., and means a set of components. As a plurality of electronic or mechanical components are assembled to each other, the module indicates an independent device having a specific function.

The wheel modules 160 are installed on the right and left sides of the cleaner body 110 in a spaced manner. For convenience, one of the two wheel modules 160 may be referred to as a first wheel module, and the other may be referred to as a second wheel module. The two wheel modules 160 are formed to moveably support the base body 112. As one module, the wheel module 160 includes a main wheel 161, a motor 162, a wheel cover 163, various types of sensors 164*a*, 164*b*, sub connectors 165*a*, 165*b*, 165*c*, and a main connector (or first connector) 166.

Concavo-convex portions for enhancing a frictional force with a ground surface are formed on an outer circumferential surface of the main wheel 161. If a frictional force between the main wheel 161 and the ground surface is not sufficient, the robot cleaner may slide from an inclined surface or may not move or rotate towards an intended direction. Accordingly, a sufficient frictional force should be obtained between the main wheel 161 and the ground surface.

Theoretically, a frictional force is unrelated to a contact area, and is variable according to a roughness of a contact surface and a weight of an object. Accordingly, if there are concavo-convex portions on the outer circumferential surface of the main wheel 161, a sufficient frictional force can be obtained as a roughness of a contact surface is increased.

The motor 162 is coupled to an inner side surface of the main wheel 161. A rotation shaft (S) of the motor 162 extends towards the main wheel 161 to thus be connected to a central region of the main wheel 161. The motor 162 may be provided at each of the right and left wheel modules 160. Accordingly, the right and left wheel modules 160 may be driven independently.

The wheel cover 163 is formed to protect the main wheel 161, to support the motor 162 and the sub connectors 165*a*, 165*b*, 165*c*, and to mount the wheel modules 160. The wheel cover 163 is formed to enclose at least part of the main wheel 161. Referring to FIG. 11, the wheel cover 163 encloses an outer circumferential surface and an inner side surface of the main wheel 161. The outer circumferential surface of the main wheel 161 is not enclosed by the wheel cover 163, but is enclosed by the cleaner body 110. An inner circumferential surface of the wheel cover 163 is spaced apart from the main wheel 161 in order not to prevent a rotation of the main wheel 161. When the wheel modules 160 have been mounted to the cleaner body 110, the wheel cover 163 is spaced apart from a ground surface.

The wheel cover 163 is formed to support the motor 162. A space (not shown) for mounting the motor 162 is provided at the wheel cover 163, and the motor 162 coupled to the main wheel 161 is inserted into the space.

Referring to FIG. 12, a boss portion 163*a*, 163*b* may be formed at the wheel cover 163. And a coupling member inserting hole (H) corresponding to the boss portion 163*a*, 163*b* is formed at a bottom surface of the cleaner body 110. The wheel module 160 is inserted into a module accommodation portion 112*a* provided at a base body 112. If the boss portion 163*a*, 163*b* is coupled to a coupling member (F) provided in the coupling member inserting hole (H), the wheel module 160 is mounted to the base body 112.

Various types of sensors 164*a*, 164*b* may be selectively installed at the wheel module 160. FIG. 11 shows that a cliff sensor 164*a* and a wheel dropping sensor 164*b* are installed at the wheel cover 163. The cliff sensor 164*a* has been aforementioned. However, a position of the cliff sensor 164*a* may be variable according to a design. For instance, as shown in FIG. 11, the cliff sensor 164*a* may be installed at a bottom part of the wheel cover 163.

The wheel dropping sensor 164*b* may be installed at the wheel cover 163. The wheel dropping sensor 164*b* includes a link (L) and a switch (not shown) so as to sense a downward state of the main wheel 161. If the main wheel 161 is downward moved from an initial position, the link (L) connected to the main wheel 161 is rotated to pressurize the switch. Then, the switch transmits a pressurization signal to the controller of the robot cleaner.

The wheel dropping sensor 164*b* may be used to control a driving of the main wheel 161, and to control the cleaner to avoid an obstacle. For instance, when a user lifts the robot cleaner, the right and left main wheels 161 are downward moved from an initial position. The controller may stop the driving of the right and left main wheels 161 based on the pressurization signal received from the switch.

If a pressurization signal is transmitted from one of the right and left main wheels 161, the controller may rotate the main wheels 161 in an opposite direction. This is an operation to control the robot cleaner to avoid an obstacle when one of the main wheels 161 performs an idling as the cleaner body 110 collides with an obstacle.

The various types of sensors 164*a*, 164*b* are electrically connected to the main connector 166 by the sub connectors 165*a*, 165*b*, 165*c*. The sub connectors 165*a*, 165*b*, 165*c* are configured to electrically connect various types of electronic components provided at the wheel module 160 to the main connector 166. Each of the sub connectors 165*a*, 165*b*, 165*c* may include a cable (C) and a connection terminal (T). The cable (C) protrudes from the main connector 166, and the connection terminal (T) is installed at the end of the cable (C). The wheel cover 163 may form an arrangement region of the cable (C), and may be provided with a cable holder (not shown) for fixing the cable (C).

FIG. 11 shows that the sub connectors 165*a*, 165*b*, 165*c* are exposed to an outer surface of the wheel cover 163. However, it is also possible to arrange the sub connectors 165*a*, 165*b*, 165*c* so as to be covered by the wheel cover 163.

The motor 162 or the sensors 164*a*, 164*b*, coupled to the wheel cover 163, may be provided with a connection socket or connector (not shown) for electrical connection. If the connection terminal (T) of each of the sub connectors 165*a*, 165*b*, 165*c* is inserted into the connection socket, the motor 162 is electrically connected to the main connector 166, and the sensors 164*a*, 164*b* are electrically connected to the main connector 166. When the components of the wheel module 160 are connected to each other physically and electrically, the wheel module 160 may be formed as a single module.

The main connector 166 may protrude from the wheel cover 163 towards the inside of the module accommodation portion 112*a*. The protruding direction of the main connector 166 from the wheel cover 163 is the same as an insertion direction of the wheel module 160 into the cleaner body 110. The module accommodation portion 112*a* for mounting the wheel module 160 is provided at the cleaner body 110, and the wheel module 160 is inserted into the module accommodation portion 112*a*. A main printed circuit board (PCB) 180 is mounted in the cleaner body 110, and one surface of the main PCB 180 is exposed to the outside through a hole of the module accommodation portion 112*a* for mounting the wheel module 160.

A socket (or second connector) 181 is provided at one surface of the main PCB 180, and the socket 181 is provided at a position corresponding to the main connector 166 And the main connector 166 is formed to have a shape corresponding to the socket 181 of the main PCB 180.

Accordingly, when the wheel module 160 is inserted into the cleaner body 110, the socket 181 of the main PCB 180 is inserted into a connection socket of the main connector 166, resulting in electrically connecting the main PCB 180 to the wheel module 160. The positions of the main connector 166 and the socket 181 may be interchanged with each other. Further, the coupling member (F) may be formed to couple the wheel cover 163 with the base body 112.

Such a physical and electrical connection structure of the wheel module 160 may be equally applied to the suction motor module 172, the battery module 173, and the suction nozzle module 120. FIG. 11 shows that the suction nozzle module 120 is also provided with a main connector (or first connector) 128 similar to the wheel module 160. The main connector (or first connector) 128 is also provided at each of the suction motor module 172 and the battery module 173.

For instance, the main connector 128 of the suction nozzle module 120 is also electrically connected to various electronic components of the suction nozzle module 120 through a sub connector (not shown). If the suction nozzle module 120 is mounted to the module accommodation portion 112*b* of the base body 112, the main connector 128 of the suction nozzle module 120 may be coupled to the socket (or second connector) 181 of the main PCB 180 in a physical and electrical manner. A protruding direction of the main connector 128 from a module mounting housing 121 is the same as an insertion direction of the suction nozzle module 120 into the module accommodation portion 112*b* of the base body 112.

The wheel modules 160, the suction motor module 172, the battery module 173 and the suction nozzle module 120 are inserted into the module accommodation portions 112*a*, 112*b*, 112*c*, 112*d*, respectively, in parallel to each other, from a lower side to an upper side of the base body 112. In FIG. 11, the base body 112 is turned inside out. Accordingly, referring to FIG. 11, the modules 160, 172, 173, 120 are inserted into the module accommodation portions 112*a*, 112*b*, 112*c*, 112*d* of the base body 112, in a downward direction.

Once the modules 160, 172, 173, 120 of the robot cleaner 100 are inserted into the module accommodation portions 112*a*, 112*b*, 112*c*, 112*d* in one direction, the robot cleaner 100 can be assembled in a fixed state of a position or a direction of the cleaner body 110. Alternatively, the robot cleaner 100 can be assembled by inserting the modules 160, 172, 173, 120 into the module accommodation portions 112*a*, 112*b*, 112*c*, 112*d* in one direction. This may reduce the number of processes required to assemble the robot cleaner 100 and simplify an assembly process, thereby enhancing an assembly characteristic of the robot cleaner 100.

Further, in the present disclosure, even when the modules 160, 172, 173, 120 need to be maintained and repaired, the modules 160, 172, 173, 120 can be separated and withdrawn through a bottom surface of the cleaner body, without disassembling the cleaner body 110. This may enhance a convenience in maintaining and repairing the robot cleaner 100.

Once the wheel module 160, the suction motor module 172, the battery module 173 and the suction nozzle module 120 are inserted into the module accommodation portions 112*a*, 112*b*, 112*c*, 112*d*, the suction motor module 172 and the battery module 173 are provided between the two wheel modules 160. The suction nozzle module 120 is provided at a front side of the suction motor module 172 and the battery module 173. Since the dust container 170 is provided at a rear side of the cleaner body, the weight of the robot cleaner 100 is entirely balanced in such a configuration.

Under the physical and electrical connection structure of the present disclosure, the wheel module 160, the suction motor module 172, the battery module 173 and the suction nozzle module 120 are physically inserted into the module accommodation portions 112*a*, 112*b*, 112*c*, 112*d*, thereby being electrically connected thereto naturally. This may facilitate an assembly between the respective modules and the cleaner body 110, and may prevent a secondary inferiority by preventing an influence on other module or components when a part of the modules 160, 172, 173, 120 is disassembled from the base body 112.

Unlike the configuration of the present disclosure, if each module is primarily physically coupled to the cleaner body 110 and then is secondarily electrically connected to the main housing 111, a difficulty in assembly, i.e., a secondary inferiority may occur. Since a physical and electrical connection should be performed by a two-time process not by a single process, the number of assembly processes is increased. Further, in case of disassemble the robot cleaner with a primary inferiority, other module or component may be influenced, resulting in a secondary inferiority.

Especially, the physical and electrical connection structure of the present disclosure is advantageous to a massive production by automation. A production process of a modernized robot cleaner is precisely performed by a robot which is operated mechanically, and a man's inaccurate intervention is excluded during the production process.

If the physical and electrical connection structure of the present disclosure is applied to the robot cleaner, an assembly between the cleaner body 110 and each module may be completed by a single automation process. The assembly means not only a physical connection, but also an electrical connection. Since the protruding direction of the main connector 166 is the same as the insertion direction of the wheel module 160, a physical coupling direction and an electrical coupling direction between modules may be understood to be the same. Accordingly, the structure of the present disclosure is very advantageous to an automation process excluding a man's intervention.

Figure 13:
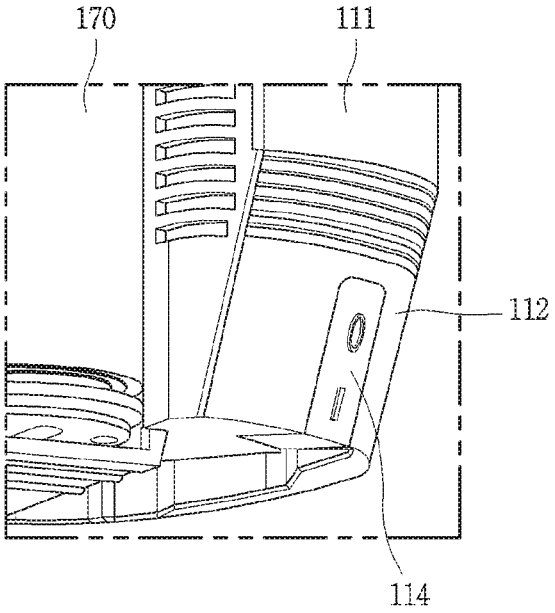
FIGS. 13 and 14 are conceptual views partially showing appearance of a main housing to which a switch cover is exposed.
Figure 14:
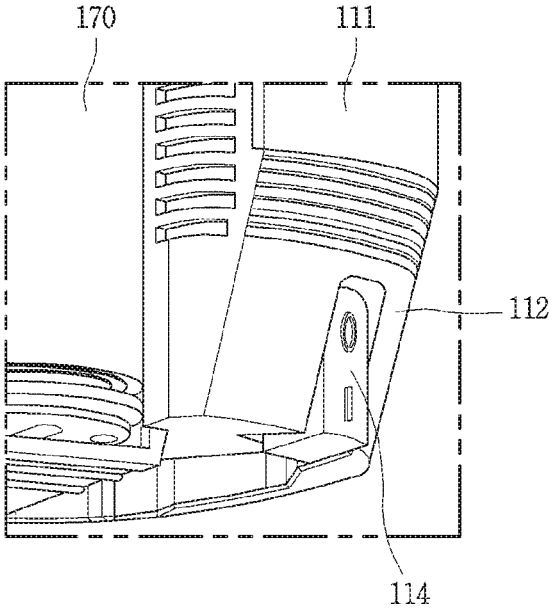
Figure 15:
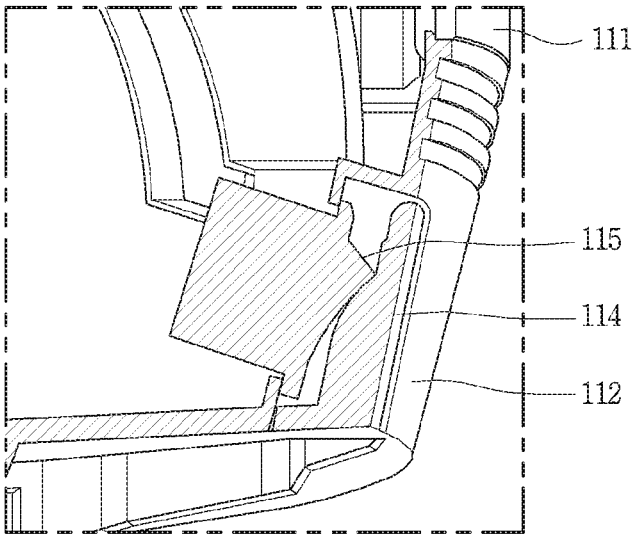
FIG. 15 is a sectional view showing an inner structure of a power switch and the switch cover.

Explanations about unexplained reference numerals of FIGS. 11 and 12 will be replaced by the aforementioned ones. Reference numeral 114 denotes a switch cover, and a power switch structure of the robot cleaner will be explained hereinafter. FIGS. 13 and 14 are conceptual views partially showing appearance of the cleaner body 110 to which the switch cover 114 is exposed, and FIG. 15 is a sectional view showing an inner structure of a power switch 115 and the switch cover 114.

The power switch 115 is configured to turn on and turn off a power of the robot cleaner. Referring to FIG. 15, the power switch 115 is formed as a toggle switch. Referring to FIGS. 13 and 14, the switch cover 114 is installed outside the power switch 115. The switch cover 114 is provided to be exposed to an outer surface of the cleaner body 110, and is formed to cover the power switch 115.

Since the robot cleaner performs an autonomous cleaning operation while moving on a predetermined region according to a preset algorithm, it is not preferable to protrude a specific part from the cleaner body 110. For instance, if the switch cover 114 protrudes from the cleaner body 110 excessively, the switch cover 114 may be locked to an object such as a wall or a door, while the robot cleaner is moving.

Further, it is preferable not to protrude the switch cover 114 from the cleaner body 110 for enhanced appearance of the robot cleaner. Especially, the switch cover 114 should not be protruding from the cleaner body 110 when the power switch 115 is turned on.

The switch cover 114 of the present disclosure forms a curved surface having a predetermined curvature together with an outer surface of the cleaner body 110, or forms a flat surface together with the outer surface of the cleaner body 110. Referring to FIGS. 13 and 15, when the power switch 115 is turned on (when part 'I' is pressed), the switch cover 114 forms a curved surface having a predetermined curvature together with the outer surface of the cleaner body 110.

On the other hand, referring to FIG. 14, when the power switch 115 is turned off (when part 'O' is pressed), the part 'I' of the switch cover 114 is protruding from the outer surface of the cleaner body 110. If the power switch 115 is formed as a push button switch and an elastic member is coupled to the switch cover 114, the switch cover 114 may not be protruding from the cleaner body 110 regardless of an 'on' or 'off' state of the power switch 115.

Figure 16:
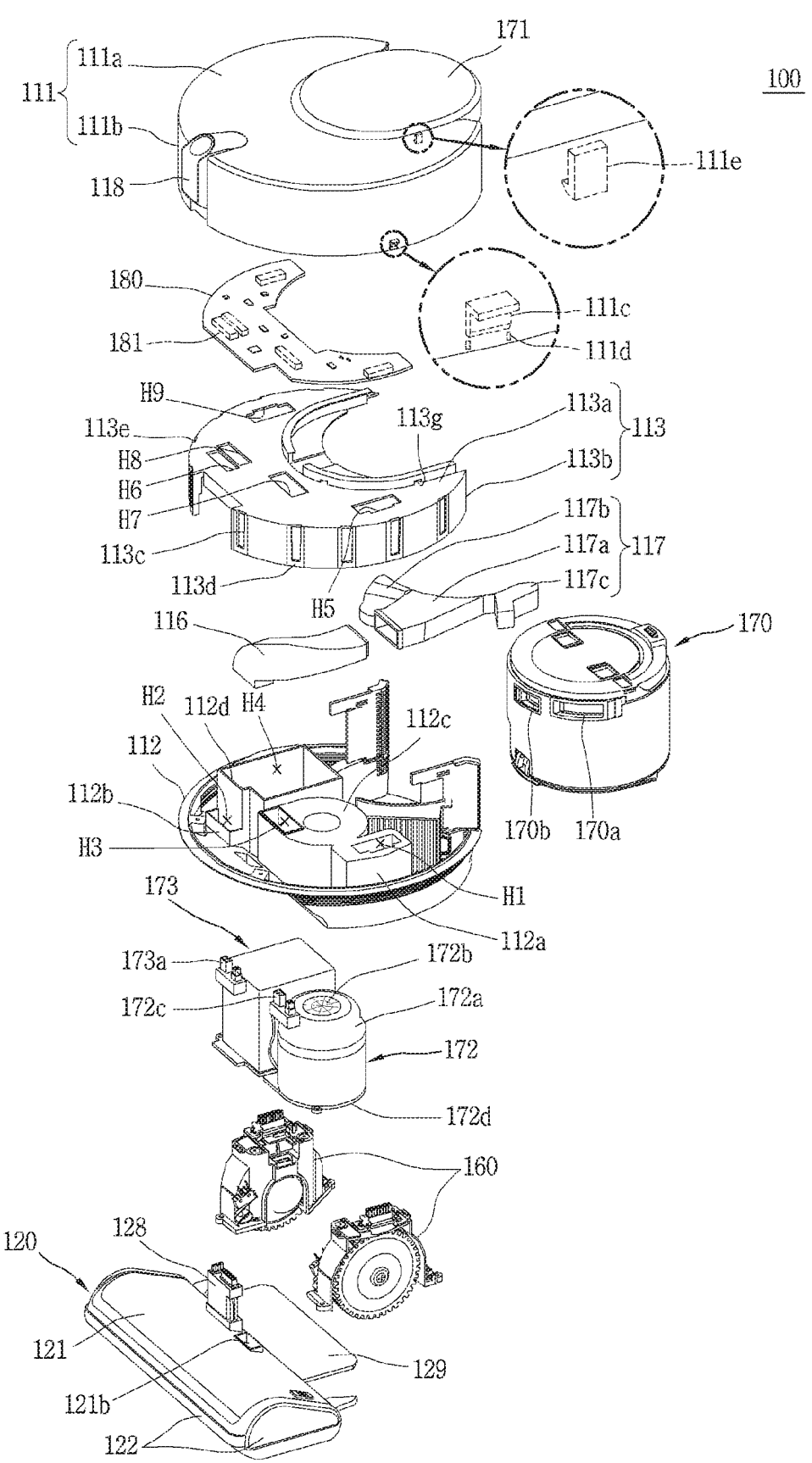
FIG. 16 is a disassembled perspective view of the robot cleaner.
Figure 17:
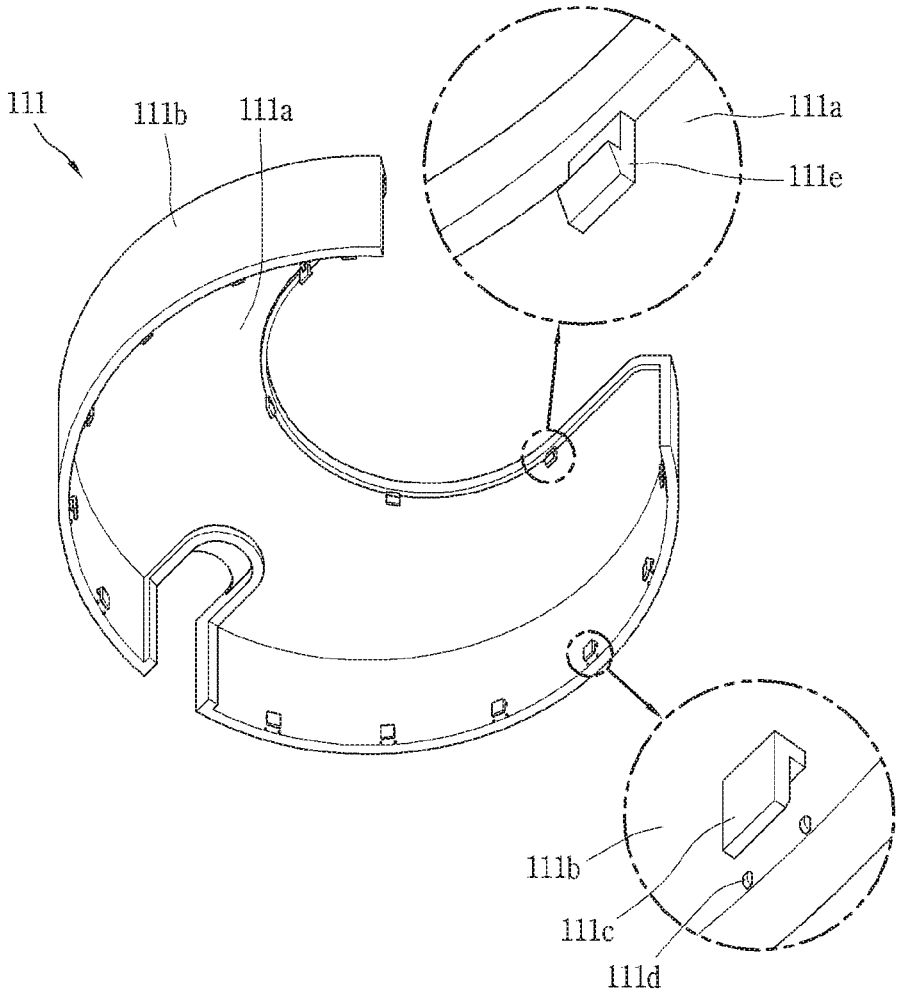
FIG. 17 is a conceptual view showing inside of an outer cover.
Figure 18:
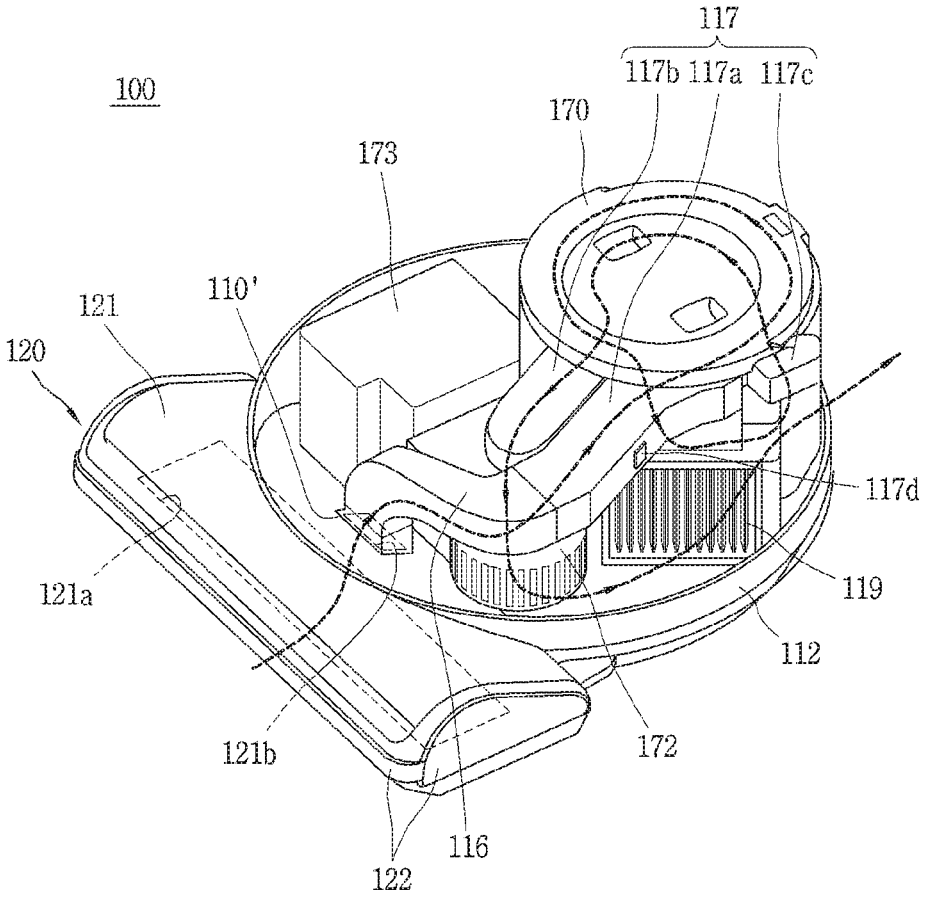
FIG. 18 is a conceptual view showing inside of the cleaner body having the outer cover and a middle body separated therefrom.

Hereinafter, an inner structure of the cleaner body 110 will be explained. FIG. 16 is a disassembled perspective view of the robot cleaner 100. FIG. 17 is a conceptual view showing inside of the outer cover 111. And FIG. 18 is a conceptual view showing inside of the cleaner body 110 having the outer cover 111 and a middle body 113 separated therefrom.

The middle body 113 is installed in the cleaner body 110 formed as the outer cover 111 and the base body 112 are coupled to each other. The main PCB 180 which constitutes the controller of the robot cleaner 100 may be provided between the outer cover 111 and the middle body 113, and may be supported by the middle body 113.

The outer cover 111 includes an outer cover portion (or outer cover plateau) 111*a* and an outer side portion (or outer cover side wall) 111*b*. The outer cover portion 111*a* is formed to cover the main PCB 180. The outer cover portion 111*a* covers a remaining region of the cleaner body 110, except for an installation space of a dust container cover 171. The outer side portion 111*b* is downward protruded towards the base body 112, from an outer edge of the outer cover portion 111*a*. The outer side portion 111*b* forms a side appearance of the cleaner body 110.

The outer cover portion 111*a* and the outer side portion 111*b* are formed to enclose the middle body 113. The middle body 113 has a similar shape to the outer cover 111. The middle body 113 is coupled to the base body 112 from an upper side of the base body 112, and includes an inner cover portion (or inner cover plateau) 113*a* and an inner side portion (or inner cover side wall) 113*b*.

The inner cover portion 113*a* is formed to support the main PCB 180. The main PCB 180 is mounted on the inner cover portion 113*a*. The inner cover portion 113*a* is formed to cover the two wheel modules 160, the suction motor module 172, and the battery module 173 each coupled to the base body 112. The inner cover portion 113*a* covers a remaining region inside the cleaner body 110 except for an installation space of the dust container 170.

The inner side portion 113*b* is downward protruded towards the base body 112, from an outer edge of the inner cover portion 113*a*, so as to face the outer side portion 111*b*. The inner side portion 113*b* is provided with a slot 113*c*. The slot 113*c* is extended in an up-down direction of the cleaner body 110. A hook coupling portion (or hook) 111*c* corresponding to the slot 113*c* is formed on the outer side portion 111*b* of the outer cover 111. The slot 113*c* is provided on the inner side portion 113*b* in plurality, and the plurality of slots 113*c* are spaced apart from each other. The hook coupling portion 111*c* is provided on the outer side portion 111*b* in plurality in correspondence to the slots 113*c*, and the plurality of hook coupling portions 111*c* are spaced apart from each other.

The hook coupling portion 111*c* is formed on an inner circumferential surface of the outer side portion 111*b*. As the outer cover 111 is coupled to the middle body 113 from an upper side to a lower side of the middle body 113, the hook coupling portion 111*c* is inserted into the slot 113*c* in a downward direction.

A width of the slot 113*c* is gradually increased in an upward direction. For instance, the slot 113*c* has an inclination angle at both sides thereof in order to guide an insertion of the hook coupling portion 111*c* thereinto. Thus, even if a coupling angle between the outer cover 111 and the middle body 113 is slightly out of a range, the hook coupling portion 111*c* can be inserted into the slot 113*c* along the inclination of the slot 113*c*.

A recess 113*e* is formed on an outer edge of the inner cover portion 113*a*, at an intersection position with the slot 113*c*. The recess 113*e* has a structure concaved towards the inside of the inner cover portion 113*a*. Thus, even if the hook coupling portion 111*c* approaches the slot 113*c* in a downward direction, the hook coupling portion 111*c* can be inserted into the slot 113*c* through the recess 113*e* without being interfered with the inner cover portion 113*a*.

A slot 113*g* may be also formed at a part of the middle body 113 which encloses the dust container 170. And a hook coupling portion 111*e* corresponding to the slot 113*g* may be further formed at a part of the outer cover 111 which encloses the dust container 170. The hook coupling portions 111*c*, 111*e* may be understood to be formed along an outer periphery of the outer cover 111. The reason is because the hook coupling portions 111*c*, 111*e* are configured to prevent an arbitrary separation of the outer cover 111 from the middle body 113. The position of the hook coupling portions 111*c*, 111*e* is shown in FIG. 17.

The middle body 113 includes a connection portion 113*d* (or connection region of the inner side portion 113*b*) formed at a lower end of the slot 113*c* and configured to connect the right and left sides of the slot 113*c*. Thus, the lower end of the slot 113*c* is not completely open, but has a restricted shape and size by the connection portion 113*d*.

The outer side portion 111*b* is provided to face the outside of the connection portion 113*d*. The hook coupling portion 111*c* is primarily protruded towards the inside of the cleaner body 110, and then is secondarily protruded towards the base body 112 in a downward direction. Thus, the hook coupling portion 111*c* is extended up to a position where it faces the inside of the connection portion 113*d*.

A protrusion 111*d* protruded towards the connection portion 113*d* is formed on the outer side portion 111*b* of the outer cover 111. The protrusion 111*d* serves to separate the outer side portion 111*b* and the inner side portion 113*b* from each other. Thus, the outer side portion 111*b* and the inner side portion 113*b* are spaced apart from each other by a distance corresponding to the protrusion 111*d*. As the outer side portion 111*b* and the inner side portion 113*b* are spaced apart from each other, heat generated from the inside of the cleaner body 110 may be discharged out through a gap between the outer side portion 111*b* and the inner side portion 113*b*.

A hole for heat radiation may often cause an accumulation of dust. However, if the slot 113*c* formed at the middle body 113 is blocked by the outer cover 111 as shown in the present disclosure, an introduction of dust to the inside of the cleaner body 110 through the slot 113*c* may be prevented.

Since heat is transferred along a temperature gradient, a heat radiation may be performed even through a small gap. Since a gap is generated between the middle body 113 and the outer cover 111 by the protrusion 111*d*, a heat radiation may be performed through the slot 113*c* and the gap. Alternatively, the protrusion 111*d* may be formed on the inner side portion 113*b* rather than the outer side portion 111*b*.

Holes H1, H2, H3, H4, open in an up-down direction of the cleaner body 110, are formed in the module accommodation portions 112*a*, 112*b*, 112*c*, 112*d*. And holes H5, H6, H7, H8, H9 corresponding to the holes H1, H2, H3, H4 of the module accommodation portions 112*a*, 112*b*, 112*c*, 112*d* are formed at the middle body 113. The socket 181 formed on a lower surface of the main PCB 180 is exposed to the inside of the module accommodation portions 112*a*, 112*b*, 112*c*, 112*d*, through the holes H1, H2, H3, H4 of the module accommodation portions 112*a*, 112*b*, 112*c*, 112*d*, and through the holes H5, H6, H7, H8, H9 of the middle body 113. Thus, the module accommodation portions 112*a*, 112*b*, 112*c*, 112*d* are not separated from the inside of the cleaner body 110, but are communicated therewith through the holes H1~H9. This configuration is for a physical coupling of the respective modules 160, 172, 173, 120 and an electrical coupling thereof naturally performed by the physical coupling, as aforementioned.

The suction motor module 172 is configured to generate a suction force to suck air of a region to be cleaned, and includes a suction motor 172*a* and a suction fan 172*b*. Once the suction motor 172*a* and the suction fan 172*b* are operated, vibrations are generated. The suction motor module 172 includes a damper 172*d* for prevention of vibrations.

The damper 172*d* is formed of an elastic material. The damper 172*d* is coupled to an inlet of the module accommodation portion 112*c* for inserting the suction motor module 172. The damper 172*d* blocks the inlet of the module accommodation portion 112*c* in order to form a bottom surface of the cleaner body 110 together with the base body 112. The damper 172*d* is adhered to an edge of the inlet of the module accommodation portion 112*c*. It may be understood that the suction motor 172*a* is coupled onto the damper 172*d*. Since the damper 172*d* is formed of an elastic material, the damper 172*d* may prevent vibrations generated from the suction motor module 172.

The battery module 173 provides a power required to drive the robot cleaner 100. The battery module 173 and the suction motor module 172 may be provided in parallel between the two wheel modules 160.

The same type of main connectors 172*c*, 173*a* as the main connectors provided at the wheel modules 160 or the suction nozzle module 120 are provided at the suction motor module 172 and the battery module 173. As aforementioned, as the suction motor module 172 and the battery module 173 are inserted into the module accommodation portions 112*c*, 112*d*, the main connectors 172*c*, 173*a* are naturally coupled to the sockets (or second connectors) 181 of the main PCB 180, the sockets exposed to the outside through the holes H3, H4 of the base body 112 and the holes H7, H8 of the middle body 113.

In an inserted state of the suction motor module 172 and the battery module 173 into the module accommodation portions 112*c*, 112*d*, the suction nozzle module 120 is inserted into the module accommodation portion 112*b*. The suction nozzle module 120 is provided with a blocking plate (or plate) 129, and the blocking plate 129 has a shape backward protruded from the module mounting housing 121. The blocking plate 129 prevents the suction motor module 172 or the battery module 173 from being visually exposed to the outside through a lower part of the cleaner body 110.

The suction nozzle module 120 is provided at a front side of the suction motor module 172 and the battery module 173, and the dust container 170 is provided at a rear side of the suction motor module 172 and the battery module 173. Thus, connection passage portions (or connection passages) 116, 117 for connecting the suction nozzle module 120 and the dust container 170 with each other should be formed to detour the suction motor module 172 and the battery module 173.

In the present disclosure, the connection passage portions 116, 117 include a flow path for connecting the suction nozzle module 120 and the dust container 170 with each other, and a flow path for connecting the dust container 170 and the suction motor module 172 with each other. The connection passage portions 116, 117 may be formed as two members.

Firstly, the upstream side member (or upstream passage) 116 is connected to the suction nozzle module 120. And the downstream side member (or downstream passage) 117 is connected to the upstream side member 116 and an inlet 170*a* of the dust container 170, and is connected to an outlet 170*b* of the dust container 170 and the suction motor module 172. The downstream side member 117 implemented as a single member forms both a suction passage 117*a* and a discharge passage 117*b*. The suction passage 117*a* and the discharge passage 117*b* are divided from each other on the basis of the dust container 170.

The upstream side member 116 is connected to the downstream side member 117 by detouring one side of the suction motor module 172, in a direction inclined from an up-down direction of the cleaner body 110. One end of the suction passage 117*a* is connected to the upstream side member 116 at one side of the suction motor module 172, and another end of the suction passage 117*a* is connected to the inlet 170*a* of the dust container 170. One end of the discharge passage 117*b* is connected to the outlet 170*b* of the dust container 170, and another end of the discharge passage 117*b* is connected to an upper part of the suction motor module 172.

A position fixing portion (or passage mounting) 117*c* is formed at an opposite side to the discharge passage 117*b*, on the basis of the suction passage 117*a*. The suction passage 117*a* is provided between the discharge passage 117*b* and the position fixing portion 117*c*. The position fixing portion 117*c* is mounted to the base body 112 so as to be supported by the base body 112.

A flow amount sensor 117*d* for measuring a flow amount of dust passing through the connection passage portions 116, 117 is installed on at least one of the upstream side member 116 and the downstream side member 117. The flow amount sensor 117*d* may measure a flow amount of dust passing through the connection passage portions 116, 117 consecutively or in stages. If the flow amount sensor 117*d* measures a flow amount of dust in stages, a signal may occur whenever more than a predetermined amount of dust passes through the connection passage portions 116, 117, and a total flow amount of dust may be measured based on the number of times that the signal occurs.

A suction force generated from the suction motor module 172 is transmitted up to the cleaning module mounting portion 121*a* of the suction nozzle module 120, through the connection passage portions 116, 117 and the dust container 170. Air sucked through the cleaning module mounting portion 121*a* is introduced into the upstream side member 116 through an outlet 121*b* of the suction nozzle module 120, and is introduced into the dust container 170 through the upstream side member 116 and the suction passage 117*a* of the downstream side member 117.

Air is separated from dust in the dust container 170. Dust is collected in the dust container 170, and air is discharged out through the outlet 170*b* of the dust container 170. Dust discharged out through the outlet 170*b* of the dust container 170 is introduced into the suction motor module 172 through the discharge passage 117*b*, and is discharged to the outside of the cleaner body 110 through the suction motor module 172 and a filter 119.

The configurations and methods of the robot cleaner in the aforesaid embodiments may not be limitedly applied, but such embodiments may be configured by a selective combination of all or part of the embodiments so as to implement many variations.

The present disclosure has the following aspects. Firstly, the cleaning module is inserted and mounted to the cleaning module mounting portion together with the supporting member, and is separated and withdrawn from the cleaning module mounting portion together with the supporting member. This is advantageous in a sanitary aspect. The reason is because most of dust is accumulated on the cleaning module rather than the supporting member, and a user can mount or separate the cleaning module to or from the cleaning module mounting portion without touching the cleaning module.

Further, since the supporting member and the cleaning module are inserted and withdrawn at a bottom part of the cleaner body in an upper and lower direction, convenience in mounting and/or separating the supporting member and the cleaning module may be enhanced. For instance, if a user lifts the cleaner body after pressurizing the manipulation portion of the hook coupling portion, the supporting member and the cleaning module may be separated from the cleaning module mounting portion by their weight. Accordingly, in the present disclosure, inconvenience in overturning the cleaner body may be solved.

Further, in the present disclosure, a type of the cleaning module is automatically recognized, and a cleaning algorithm is selected according to the recognized type of the cleaning module. This may enhance performance of the robot cleaner having an autonomous driving function and an automatic cleaning function.

Further, in the present disclosure, the respective modules of the robot cleaner are inserted into the plurality of module accommodation portions open at a lower side of the base body, in an upward direction of the base body. Since an assembly direction of the respective modules is the same, the number of assembly processes to manufacture the robot cleaner may be smaller than that in the conventional art. Further, since the respective modules are assembled in the same manner, an assembly characteristic of the robot cleaner may be enhanced through the same assembly process.

Further, in the present disclosure, since the plurality of modules are physically inserted into the module accommodation portions, an electrical connection between the main PCB and the modules is performed naturally. This may allow the physical coupling and the electrical connection to be implemented as a single process, thereby enhancing an assembly characteristic of the robot cleaner.

Further, in the present disclosure, a heat radiation is performed through the slots formed at the middle body, and the slots are formed along an edge of the middle body. Thus, a heat radiating structure including the slots does not interfere with an assembly structure that the plurality of modules are inserted in one direction. The slots of the heat radiating structure also serve to guide a coupling of the outer cover by an inclined shape thereof.

Further, in the present disclosure, the connection passages are formed in the cleaner body as two members, and the connection passages are connected to the dust container by detouring one side of the suction motor module, in an inclined direction. Thus, the passage structure including the two members does not interfere with the assembly structure that the plurality of modules are inserted in one direction.

Therefore, an aspect of the detailed description is to provide a cleaner capable of enhancing a user's sanitary aspect when managed and maintained. Especially, an aspect of the detailed description is to provide a cleaner capable of allowing a user to disassemble or separate components from a cleaner body without touching dust by hand.

Another aspect of the detailed description is to provide a cleaner capable of selectively replacing a predetermined type of cleaning member coupled to a cleaner body, and having an easy replacement structure. Another aspect of the detailed description is to provide a cleaner capable of automatically recognizing a type of a cleaning member coupled to a cleaner body.

Another aspect of the detailed description is to provide a cleaner having a structure that a plurality of modules are coupled to a cleaner body in one direction, in order to reduce the number of assembly processes than in the conventional art. Another aspect of the detailed description is to provide a cleaner having a structure that a plurality of modules are electrically coupled to a cleaner body as the plurality of modules are physically coupled to the cleaner body.

Another aspect of the detailed description is to provide a radiation structure and a flow path structure which do not interfere with a structure to enhance assembly processes of a robot cleaner. Another aspect of the detailed description is to provide a cleaner capable of coupling or separating a supporting member and a cleaning module to or from a cleaner body in a coupled manner.

To achieve these and other aspects and in accordance with the purpose of this specification, as embodied and broadly described herein, there is provided a robot cleaner, comprising: a cleaner body having a module mounting portion; a supporting member inserted and mounted to the cleaning module mounting portion, and separated and withdrawn from the cleaning module mounting portion, through a bottom part of the cleaner body; and a cleaning module coupled to the supporting member so as to be inserted or withdrawn together with the supporting member when the supporting member is inserted or withdrawn.

The cleaning module includes: a rotation rod rotatably supported by the supporting member, and coupled to the rotation driving portion by being inserted into the cleaning module mounting portion; and a cleaning member coupled to an outer circumferential surface of the rotation rod, and configured to clean a floor by being rotated together with the rotation rod when the rotation rod is rotated by a rotation driving force transmitted from the rotation driving portion.

The rotation rod includes: a rotation coupling member exposed to outside through one end of the rotation rod in an axial direction, and formed to be pressurized toward inside of the rotation rod; and an elastic member configured to provide an elastic force such that the rotation coupling member pressurized toward the inside of the rotation rod is restored to an initial position.

The cleaning module mounting portion includes an inclined surface formed at a contact position with the rotation coupling member while the cleaning module is being mounted such that the rotation coupling member is slid on a slant surface, the inclined surface being configured to gradually pressurize the rotation coupling member toward the inside of the rotation rod while the cleaning module is being mounted. The inclined surface is formed to be closer to the rotation coupling member as it is towards inside of the cleaning module mounting portion.

The rotation driving portion is formed to accommodate the rotation coupling member therein. And in a mounted state of the cleaning module to the cleaning module mounting portion, the rotation coupling member is pressurized by an elastic force provided from the elastic member to thus be inserted into the rotation driving portion.

The rotation driving portion is formed to accommodate the rotation coupling member therein. While the cleaning module is being mounted, the rotation coupling member sequentially passes through the inclined surface and an inner plane of the cleaning module mounting portion, and then is restored to an initial position by an elastic force provided from the elastic member to thus be inserted into the rotation driving portion.

The supporting member includes: a first supporting portion which encloses one end of the rotation rod so as to relative-rotatably support the rotation rod, and a second supporting portion which encloses another end of the rotation rod; and a first connection portion and a second connection portion spaced apart from each other, and configured to connect the first and second supporting portions with each other. And the cleaning member is exposed to a space between the first and second connection portions to clean a floor.

The cleaning module mounting portion is provided with a protrusion protruding towards the supporting member, and the supporting member is provided with a hook coupling portion so as to be prevented from being separated from the cleaning module mounting portion.

The hook coupling portion includes: a first part protruding from one end of the supporting member towards inside of the cleaning module mounting portion; a second part bent from the first part, and protruding towards outside of the cleaning module mounting portion; a manipulation portion protruding from an end of the second part so as to manipulate the hook coupling portion; and a locking protrusion protruding from a middle region of the second part towards the protrusion, so as to be locked to the protrusion when the supporting member is inserted into the cleaning module mounting portion.

The locking protrusion includes: an inclined surface which contacts the protrusion while the supporting member is being inserted, and formed to be slidable along a surface of the protrusion; and a locking surface formed at an opposite side to the inclined surface, and formed to contact the protrusion in a mounted state of the supporting member to the cleaning module mounting portion.

In a mounted state of the supporting member to the cleaning module mounting portion, the manipulation portion is spaced apart from the cleaner body so as to be pressurized towards the cleaner body. When the manipulation portion is pressurized in an axial direction of the rotation rod, a coupled state between the protrusion and the locking protrusion is released.

The hook coupling portion is formed at an opposite side to the rotation coupling member. If a coupled state between the protrusion and the locking protrusion is released, the supporting member and the cleaning module are tilted on the basis of the rotation coupling member to thus be separated from the cleaning module mounting portion.

The cleaning module includes a first type cleaning module and a second type cleaning module which are selectively mountable to the supporting member, and a rotation rod of the first type cleaning module and a rotation rod of the second type cleaning module are provided with different number of contact terminals on the same position. The rotation driving portion is provided with a contact switch at a contact position with the contact terminal. And a controller of the cleaner recognizes a type of the cleaning module mounted to the cleaning module mounting portion according to the number of the contact terminal contacting the contact switch, and selects a cleaning algorithm of the cleaner based on the recognized type of the cleaning module.

According to another aspect of the present disclosure, there is provided a robot cleaner, comprising: a base body which forms a bottom part of a cleaner body; a wheel module configured to moveably support the base body; a suction motor module; a battery module; a suction motor module formed to suck air of a region to be cleaned, wherein the base body is provided with a plurality of module accommodation portions open towards a lower side of the robot cleaner, and wherein the wheel module, the suction motor module, the battery module and the suction nozzle module are inserted into the module accommodation portions, respectively, in parallel to each other, from a lower side to an upper side of the base body.

The base body is formed to accommodate therein the components of the robot cleaner. The wheel module is formed in two. The first wheel module is installed at one of right and left sides of the base body, and the second wheel module is installed at another side. The first and second wheel modules are spaced apart from each other.

The suction motor module and the battery module are arranged between the first and second wheel modules. The suction nozzle module is arranged at a front side of the suction motor module and the battery module. A hole open in an up-down direction of the cleaner body is formed in the module accommodation portion.

The robot cleaner further includes: a main printed circuit board (PCB) installed in the cleaner body, and provided on the module accommodation portion; and a socket installed on a lower surface of the main PCB, and exposed to inside of the module accommodation portion through the hole, wherein each of the first wheel module, the second wheel module, the suction motor module, the battery module, and the suction nozzle module is provided with a connector formed at a position corresponding to the socket, and wherein as the first wheel module, the second wheel module, the suction motor module, the battery module, and the suction nozzle module are inserted into the module accommodation portions, the connector is connected to the socket.

The robot cleaner further includes a middle body coupled onto the base body. The main PCB is provided on the middle body, and is supported by the middle body. And a hole, through which the socket is exposed to the module accommodation portion, is formed at the middle body at a position corresponding to the hole of the base body.

The robot cleaner further includes: a middle body coupled onto the base body; and an outer cover formed to enclose the middle body, and forming an appearance of the cleaner body, wherein the middle body includes: an inner cover portion formed to support the main PCB, and formed to cover the first wheel module, the second wheel module, the suction motor module and the battery module; an inner side portion downward protruded towards the base body, from an outer edge of the inner cover portion; and a slot formed on the inner side portion, and extended in an up-down direction of the cleaner body, and wherein the outer cover includes: an outer cover portion formed to cover the main PCB; an outer side portion downward protruded towards the base body from an outer edge of the outer cover portion, and formed to enclose the inner side portion; and a hook coupling portion formed on an inner circumferential surface of the outer side portion, and inserted into the slot in a downward direction as the outer cover is coupled to the middle body.

A width of the slot is gradually increased in an upward direction in order to guide an insertion of the hook coupling portion. A recess is formed on an outer edge of the inner cover portion at an intersection position with the slot, in order to pass the hook coupling portion inserted into the slot therethrough. The slot is formed in plurality, and the plurality of slots are spaced apart from each other.

At least one of the middle body and the outer cover further includes a protrusion. And the protrusion is protruded from one of the inner side portion and the outer side portion towards the other, such that the inner side portion and the outer side portion are spaced apart from each other.

The middle body further includes a connection portion formed at a lower end of the slot and configured to connect right and left sides of the slot with each other. The outer side portion is provided to face the outside of the connection portion. And the hook coupling portion is protruded from an inner circumferential surface of the outer side portion, and is extended up to a position where it faces the inside of the connection portion.

The outer cover further includes a protrusion protruded towards the connection portion from the outer side portion, and the connection portion is provided between the hook coupling portion and the protrusion. The suction motor module includes a damper formed of an elastic material. And the damper is coupled to an inlet of the module accommodation portion for inserting the suction motor module, and the damper blocks the inlet of the module accommodation portion in order to form a bottom surface of the cleaner body together with the base body.

The robot cleaner further includes: a dust container detachably coupled to the cleaner body, and provided at a rear side of the suction motor module and the battery module; and connection passage portions configured to connect the suction nozzle module and the dust container with each other, and configured to connect the dust container and the suction motor module with each other, wherein the connection passage portions are formed by: an upstream side member connected to the suction nozzle module; and a downstream side member connected to the upstream side member and an inlet of the dust container, and connected to an outlet of the dust container and the suction motor module. The upstream side member is connected to the downstream side member by detouring one side of the suction motor module, in a direction inclined from an up-down direction of the cleaner body.

The downstream side member includes: a suction passage having one end connected to the upstream side member at one side of the suction motor module, and having another end connected to the inlet of the dust container; a discharge passage having one end connected to the outlet of the dust container, and having another end connected to an upper part of the suction motor module; and a position fixing portion mounted to the base body so as to be supported by the base body, and formed to be adhered to an outer circumferential surface of the dust container, and wherein the suction passage is provided between the discharge passage and the position fixing portion. A flow amount sensor for measuring a flow amount of dust passing through the connection passage portions is installed on at least one of the upstream side member and the downstream side member.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An autonomous cleaner, comprising:

a base body that forms a bottom of a cleaner body and includes a plurality of module accommodation recesses that open downwards;

a first wheel module and a second wheel module that, when installed in the base body, are spaced apart from each other and moveably support the base body;

a suction motor module that generates an air flow and a battery module that provides power to drive the suction motor, the suction motor module and the battery module, when installed in to base body, being at least partially positioned between the first and second wheel modules; and a cleaner head module that is provided forward of the suction motor module and the battery module and uses the air flow from the suction motor to suck in air from a region to be cleaned, wherein accommodation recesses are configured such that the first wheel module, the second wheel module, the suction motor module, the battery module, and the cleaner head module can be inserted into the module accommodation recesses, respectively, parallel to each other in a direction from a lower side to an upper side of the base body, wherein the suction motor module includes a damper formed of an elastic material, and wherein the damper is coupled to an inlet of a corresponding one of the module accommodation recesses that receives the suction motor module, and the damper blocks the inlet of the one of the module accommodation recess to form a bottom surface of the cleaner body together with the base body.

2. The autonomous cleaner of claim 1, wherein each of the module accommodation recesses includes a hole that opens in a direction extending between the upper side and lower side, wherein each of the first wheel module, the second wheel module, the suction motor module, the battery module, and the cleaner head module is provided with a first connector, wherein the autonomous cleaner further includes:

a printed circuit board (PCB) installed in the cleaner body; and second connectors installed on a lower surface of the PCB, and exposed to interiors of the module accommodation recesses through the holes, wherein each of the first connectors is formed at a position corresponding to one of the second connectors in a corresponding one of the module accommodation recesses, and wherein as the first wheel module, the second wheel module, the suction motor module, the battery module, and the cleaner head module are inserted into the module accommodation portions, the first connectors are coupled, respectively, to the second connectors.

3. The autonomous cleaner of claim 2, further comprising a middle body coupled onto the base body, wherein the PCB is provided on the middle body, and is supported by the middle body, and wherein holes, through which the second connectors are exposed to the module accommodation recesses, are formed at the middle body at positions corresponding to the holes of the base body.

4. The autonomous cleaner of claim 2, further comprising:

a middle body that is coupled onto the base body; and an outer cover that encloses the middle body and combines with the base body to form an appearance of the cleaner body, wherein the middle body includes:

an inner cover plateau that supports the PCB and at least partially covers the first wheel module, the second wheel module, the suction motor module and the battery module;

an inner cover side wall that protrudes vertically towards the base body, from an outer edge of the inner cover plateau; and a slot that is formed on the inner cover side wall portion and extends in a vertical direction of the cleaner body, and wherein the outer cover includes:

an outer cover plateau that covers the PCB;

an outer cover side wall that extends towards the base body from an outer edge of the outer cover plateau, and is formed to enclose the inner cover side wall; and a hook that is formed on an inner circumferential surface of the outer cover side wall and is inserted into the slot in a downward direction as the outer cover is coupled to the middle body.

5. The autonomous cleaner of claim 4, wherein a width of the slot increases along an upward direction to guide an insertion of the hook into the slot.

6. The autonomous cleaner of claim 4, wherein a recess is formed on an outer edge of the inner cover plateau at an intersection position with the slot and passes the hook inserted into the slot therethrough.

7. The autonomous cleaner of claim 4, wherein the slot is included in a plurality of slots formed on the middle body, and the plurality of slots are spaced apart from each other.

8. The autonomous cleaner of claim 4, wherein at least one of the middle body or the outer cover further includes a protrusion, and wherein the protrusion extends from one of the inner cover side wall or the outer cover side wall and towards another one of the inner cover side wall or the outer cover side wall, such protrusion spaces apart the inner cover side wall and the outer cover side wall.

9. The autonomous cleaner of claim 4, wherein the middle body further includes a connection region of the inner side wall cover that is formed at a lower end of the slot and extends between right and left sides of the slot, wherein the outer cover side wall is provided to face an outside surface of the connection region of the inner side wall, and wherein the hook protrudes from an inner circumferential surface of the outer cover side wall, and extends up to a position where a portion of the hook faces inside of the connection region of the inner side wall cover.

10. The autonomous cleaner of claim 9, wherein the outer cover further includes a protrusion that extends towards the connection region of the inner side wall cover from the outer cover side wall, and wherein the connection region of the inner side wall cover is provided between the hook and the protrusion.

11. The autonomous cleaner of claim 1, further comprising:

a dust container detachably coupled to the cleaner body, the suction motor module and the battery module being positioned between the cleaner head module and the dust container; and connection passages that connect the cleaner head module and the dust container, and connect the dust container and the suction motor module, wherein the connection passages include:

an upstream side having a first passage connected to the cleaner head module; and a downstream side having a second passage connected to the upstream passage and an inlet of the dust container, and a third passage connected to an outlet of the dust container and the suction motor module.

12. The autonomous cleaner of claim 11, wherein the upstream passages is connected to the downstream passage by extending around one side of the suction motor module in a direction inclined from a vertical direction of the cleaner body.

13. The autonomous cleaner of claim 11, wherein the downstream passage includes:

a suction passage having one end connected to the upstream passage at one side of the suction motor module, and having another end connected to the inlet of the dust container;

a discharge passage having one end connected to the outlet of the dust container, and having another end connected to an upper part of the suction motor module; and a passage mounting connected to the base body so as to be supported by the base body, and formed to contact to an outer circumferential surface of the dust container, and wherein the suction passage is provided between the discharge passage and the passage mounting.

14. The autonomous cleaner of claim 11, further comprising:

a flow amount sensor that measures a flow passing through the connection passages and installed on at least one of the upstream passage or the downstream passage.

15. An autonomous cleaner comprising:

a cleaner body housing a printed circuit board (PCB) that includes a plurality of second connectors, the cleaner body including an outer cover and a base body that forms a bottom of the cleaner body, wherein:

the base body includes a plurality of module accommodation recesses that open downwards and that receive a plurality of modules, the plurality of modules include:

a first wheel module and a second wheel module that support the autonomous cleaner, a suction motor module that generates an air flow and a battery module that provides power to drive the suction motor, the suction motor module and the battery module being installed at least partially between the first and second wheel modules, and a cleaner head module that is provided forward of the suction motor module and the battery module and uses the air flow from the suction motor to suck in air from a region to be cleaned, each of the first wheel module, the second wheel module, the suction motor module, the battery module, and the cleaner head module includes a first connector, the PCB includes a plurality of second connectors, the module accommodation recesses includes holes that expose the second connectors of the PCB, when the first wheel module, the second wheel module, the suction motor module, the battery module, and the cleaner head module are inserted into the module accommodation portions, the first connectors are coupled to respective ones of the second connectors, the suction motor module includes a damper formed of an elastic material, and the damper is coupled to an inlet of a corresponding one of the module accommodation recesses that receives the suction motor module, and the damper blocks the inlet of the one of the module accommodation recess to form a bottom surface of the cleaner body together with the base body.

16. The autonomous cleaner of claim 15, further comprising a middle body coupled onto the base body, wherein the PCB is provided on and is supported by the middle body.

17. The autonomous cleaner of claim 16, wherein the middle body includes:

an inner cover plateau that supports the PCB;

an inner cover side wall that protrudes vertically towards the base body, from an outer edge of the inner cover plateau; and a slot that is formed on the inner cover side wall portion and extends in a vertical direction, and wherein the outer cover includes:

an outer cover plateau that covers the PCB;

an outer cover side wall that extends towards the base body from an outer edge of the outer cover plateau, and is formed to enclose the inner cover side wall; and a hook that is formed on an inner circumferential surface of the outer cover side wall and is inserted into the slot in a downward direction when the outer cover is coupled to the middle body.

18. The autonomous cleaner of claim 15, further comprising:

a dust container detachably coupled to the cleaner body, the suction motor module and the battery module being positioned between the cleaner head module and the dust container; and connection passages that connect the cleaner head module and the dust container, and connect the dust container and the suction motor module, wherein the connection passages include:

an upstream side having a first passage connected to the cleaner head module; and a downstream side having a second passage connected to the upstream passage and an inlet of the dust container, and a third passage connected to an outlet of the dust container and the suction motor module.

19. The autonomous cleaner of claim 15, wherein the cleaner head module includes a plate that extends backwards to cover the suction motor module and the battery module.

* * * * *